US006148549A

United States Patent [19]

Bykov et al.

[11] Patent Number: 6,148,549

[45] Date of Patent: Nov. 21, 2000

[54] MACHINE FOR UNCOVERING A PIPELINE AND OPERATING ELEMENT

[75] Inventors: Alexandr V. Bykov, Kiev; Stanislav K Vasilenko, Kremenchug, both of Ukraine; Alexandr S. Dzhardzhimanov, Moscow, Russian Federation; Marat Sh. Ibragimov, Moscow, Russian Federation; Alexandr S. Kumylganov, Moscow, Russian Federation; Jury M. Mamontov, Moscow, Russian Federation; Aly A. Movchan, Kremenchug, Ukraine; Vladimir D. Musiiko; Vladimir P. Reshetnikov, both of Kiev, Ukraine; Valery D. Chernaev, Moscow, Russian Federation; Viktor I Yakovlev, Krementschug, Ukraine

[73] Assignees: Obschestvo S Orgranichennoi Otvetstvennostju Nauchnoissledovatelsky I Teknichesky Tsentr "Rotor", Kiev, Ukraine; Aktsionernoe Obschestvo OtkrytogoTipa Aktsionernaya Kompania Po Transportu Nefti "Transneft", Moscow, Russian Federation; National Stock Company, Kremenchuk, Ukraine

[21] Appl. No.: 09/341,437

[22] PCT Filed: Jan. 9, 1998

[86] PCT No.: PCT/UA98/00001

§ 371 Date: Aug. 30, 1999

§ 102(e) Date: Aug. 30, 1999

[87] PCT Pub. No.: WO97/30758

PCT Pub. Date: Jul. 16, 1998

[30] Foreign Application Priority Data

Jan. 9, 1997 [UA] Ukraine ..... 97010085

[51] Int. Cl.[7] ..... E02F 5/06; E02F 5/10

[52] U.S. Cl. ..... 37/352; 37/464; 37/466

[58] Field of Search ..... 37/352, 347, 462–464, 37/466

[56] References Cited

FOREIGN PATENT DOCUMENTS

| | | |
|---|---|---|
| 0010915 | 5/1980 | European Pat. Off. . |
| 2034960 | 5/1995 | Russian Federation . |
| 280340 | 1/1971 | U.S.S.R. . |
| 302438 | 6/1971 | U.S.S.R. . |
| 306230 | 8/1971 | U.S.S.R. . |
| 484288 | 12/1975 | U.S.S.R. . |
| 151253 | 6/1977 | U.S.S.R. . |
| 1198166 | 12/1985 | U.S.S.R. . |

*Primary Examiner*—Christopher J. Novosad
*Attorney, Agent, or Firm*—Burns, Doane, Swecker & Mathis, L.L.P.

[57] ABSTRACT

The invention pertains to construction earth-moving machinery for overhauling of main oil pipelines, gas pipelines, or pipelines for other purposes, namely machines for uncovering pipelines of a broad range of diameters, with trench working much lower than the lower generatrix of the pipeline for digging under it in repair of the pipeline in the trench without its lifting. Furthermore, the invention pertains to operating elements, predominantly of machines for uncovering of pipelines.

30 Claims, 10 Drawing Sheets

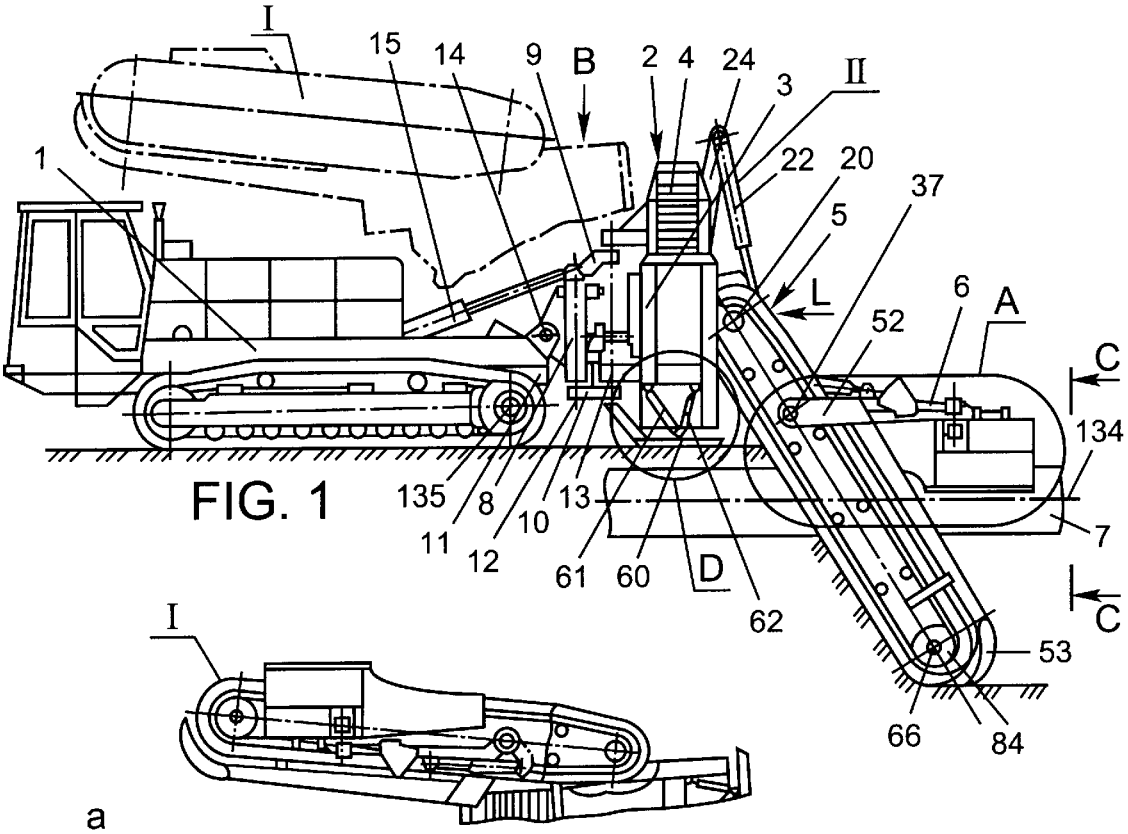
FIG. 1
FIG. 2
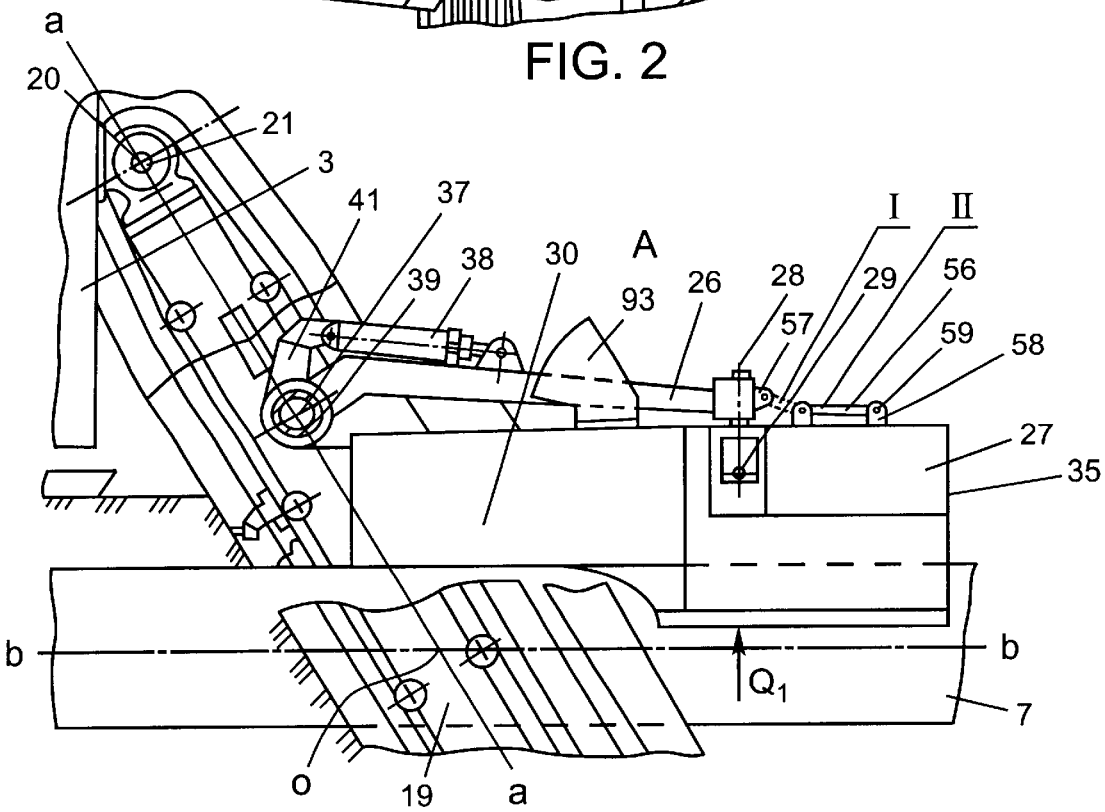
FIG. 3

FIG. 21
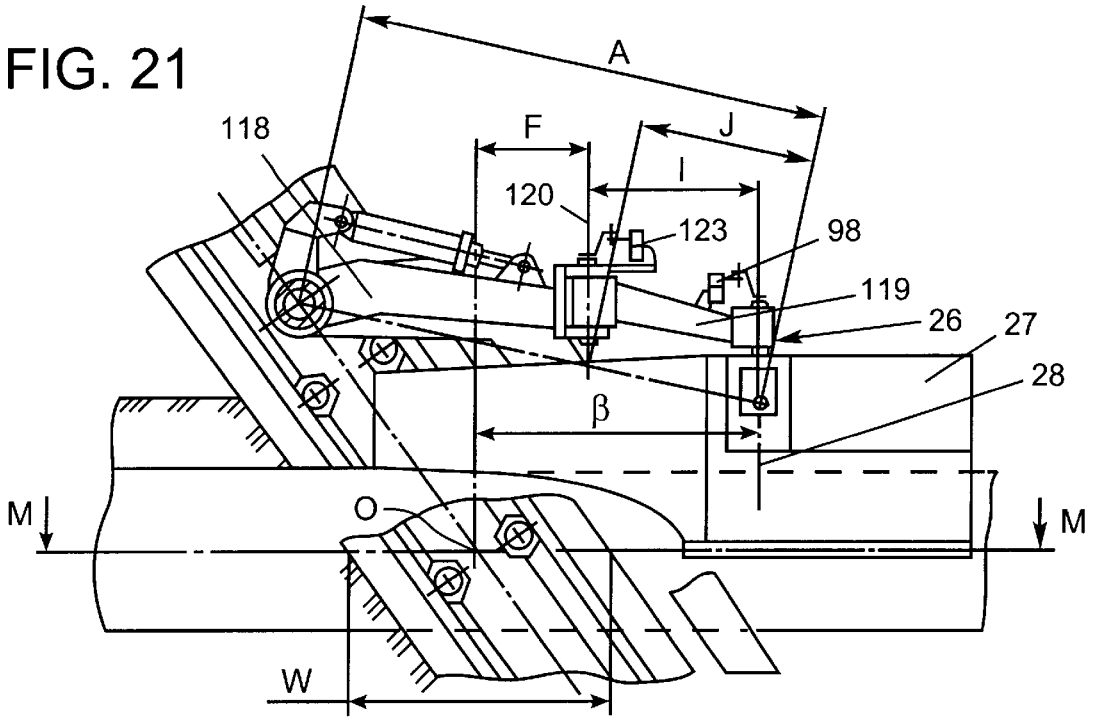
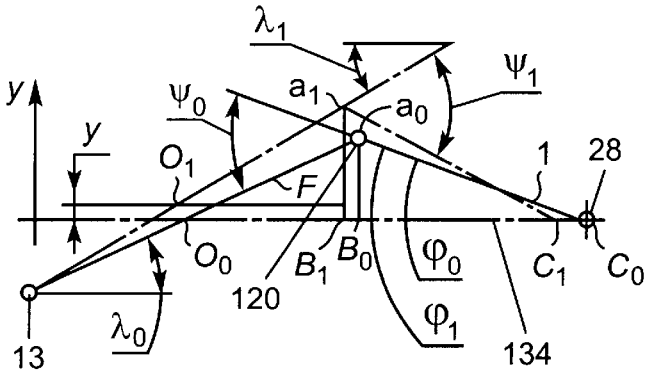
FIG. 22
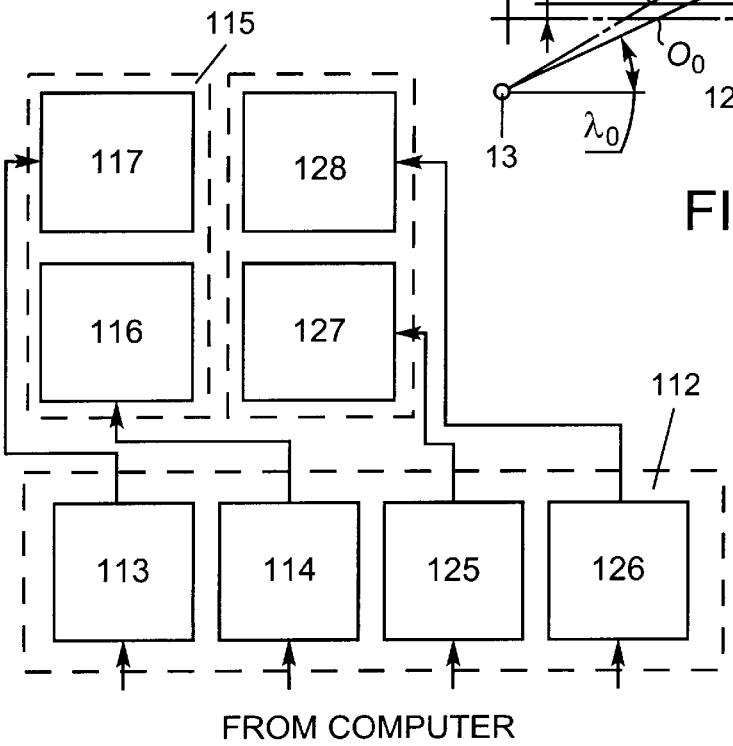
FIG. 15

FIG. 18
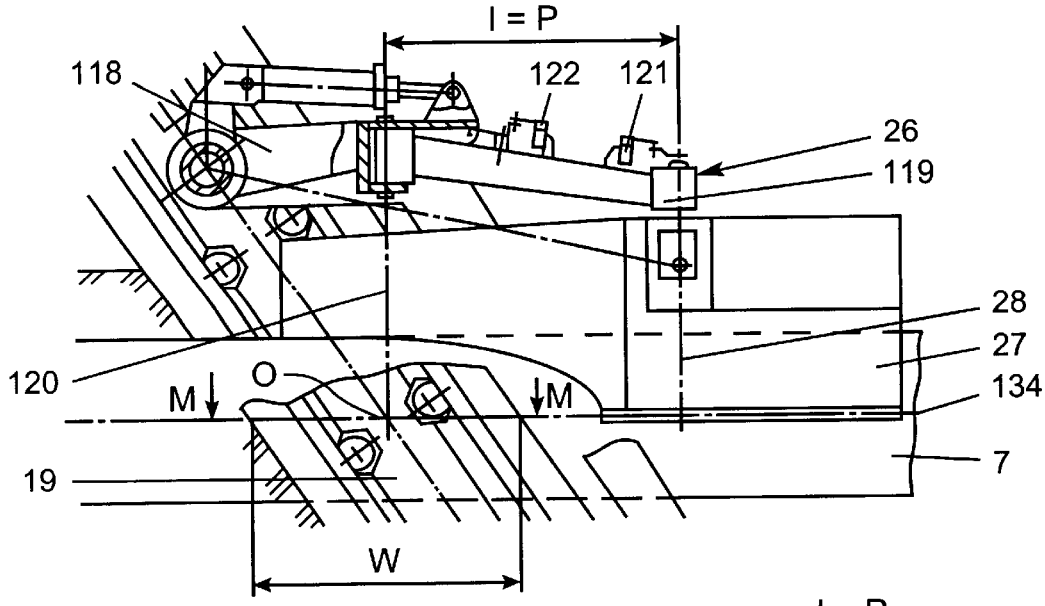
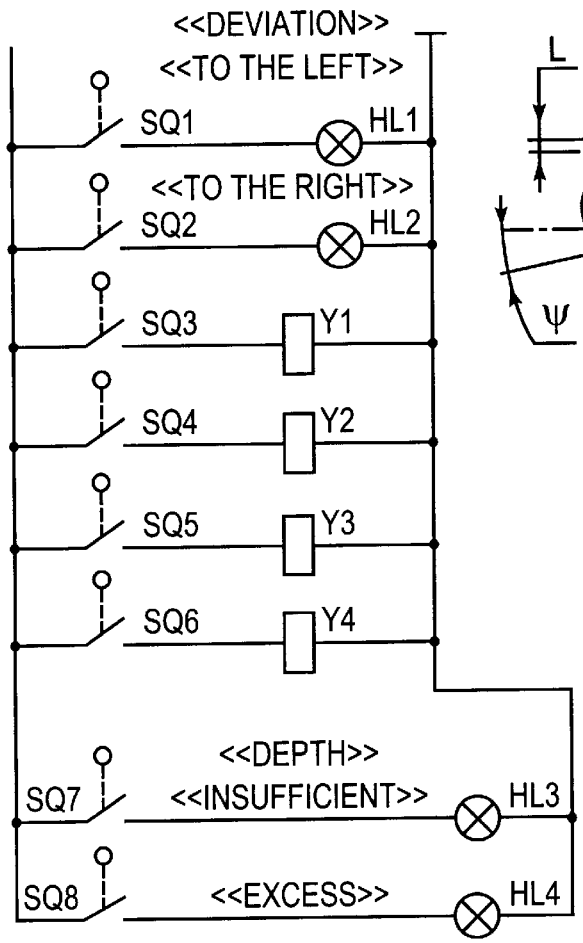
FIG. 20
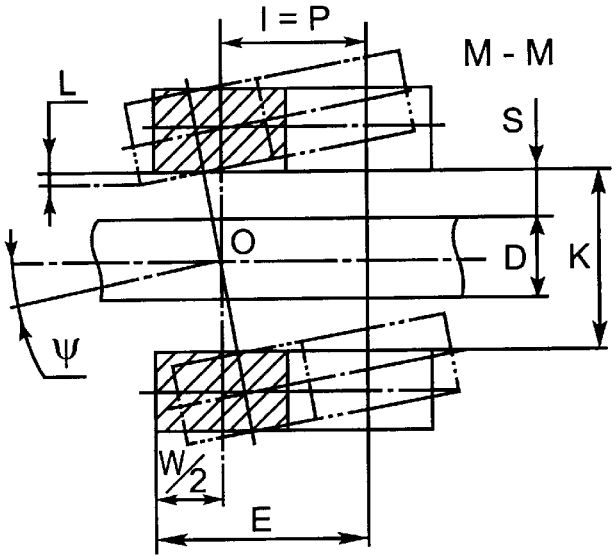
FIG. 19

MACHINE FOR UNCOVERING A PIPELINE AND OPERATING ELEMENT

FIELD OF THE INVENTION

The invention pertains to the construction earth-moving machinery for overhauling of the main oil pipelines, gas pipelines, or pipelines for other purposes, namely machines for uncovering pipelines of a broad range of diameters, with the trench working much lower than the lower generatrix of the pipeline for digging under it in repair of the pipeline in the trench without its lifting. Furthermore, the invention pertains to the operating elements, predominantly of machines for uncovering of pipelines.

PRIOR ART

Known is a machine for uncovering of a pipeline, comprising a base underframe and working machinery including the contour follower made in the form of an arm mounted with the ability of turning in the vertical plane by means of the spring clamping device, and support on the pipeline, which is rigidly mounted on the arm and is made in the form of a screw blade picker (USSR Auth. Cert. No.607897, IPC: E02F May 2, 1975).

The disadvantage of the known machine is the impossibility of moving the arm into the transportation position and back, as well as impossibility of transferring a great support pressure to the pipeline, as a result of the support being made in the form of a picker.

Known is a machine for pipeline uncovering, comprising a base underframe and working machinery incorporating a frame with a device for clearing away earth and a rotor sectioned operating element, which is hinged to the base underframe with the ability of turning in the horizontal plane on two axes and in the vertical plane, and the contour follower made in the form of a wheel support on the ground, which is rigidly mounted on the above frame (USSR Auth. Cert. No.692945, IPC: E02F May 8, 1975).

The disadvantages of the known machine are the large overall dimensions and low maneuverability in the transportation and working position. The ability of the working machinery to turn in the horizontal plane on two axes does not practically improve the machine maneuverability in view of the absence of the power drive for turning the frame with the device for clearing away earth in the longitudinal plane, and impossibility of changing the position of the center of turn of the base underframe.

Known is a machine for pipeline uncovering, comprising the base underframe and the working machinery incorporating the frame with the device for clearing away earth and rotor sectioned operating element, which is connected to the base underframe with the ability of turning in the horizontal and vertical planes, and the contour follower made in the form of a support on the ground, with wheels. Here, in order to provide the turning in plan on an axis located in front of the center of turn of the base underframe, the connection of the latter with the frame is made in the form of a curvilinear beam with a carriage moving along it (USSR Auth. Cert. No.484288, IPC: E02F May 8, 1971).

Use in the known machine of the curvilinear beam with the carriage, does not yield a reduction in the machine overall dimensions or an essential increase in its maneuverability, in view of the impossibility of providing a great angle of rotation in plan of the base underframe and the working machinery. Moreover, the availability of a curvilinear beam with a carriage in the design, makes its design more complicated and lowers its reliability under high working loads.

Known is an earth-moving machine comprising the base underframe and the working machinery incorporating the frame with the device for clearing away earth and a chained operating element, which is hinged to the base underframe with the ability of turning in the horizontal and vertical planes. Here, the working machinery has power drives for its turning in the horizontal and vertical planes, and the operating element is fitted with a power drive and is mounted with the ability of forced rotation in the longitudinal plane on the axis of the drive shaft by a power drive (USSR Auth. Cert. No.184732, IPC: E02F, 1965).

The known machine has small overall dimensions and high maneuverability in the transportation position, yet it cannot be used for pipeline uncovering. Here, the presence of power drives for turning of the frame with the device for clearing away earth, in the longitudinal plane and in plan, does not influence the machine maneuverability in the working position.

The closest to the claimed machine is the known machine for uncovering of pipelines, comprising the base underframe and the working machinery incorporating a frame with a device for clearing away earth, which is hinged to the base underframe with the ability of turning in the horizontal and vertical planes, an operating element which is made in the form of chain portions mounted on the frame with the device for clearing away earth, a contour follower made in the form of a support on the pipeline, which is hung on hinges with the ability of turning in the horizontal and vertical planes, and a device to control the position of the working machinery with respect to the pipeline. Unlike the claimed machine, in the known machine the working machinery is fitted with a wheel support on the ground, extendable by means of a power drive, and located in front of the operating element, the operating element is rigidly mounted, while the support on the pipeline is fastened to the frame with the device for clearing away earth. Here, the support on the pipeline is made in the form of a carriage (USSR. Auth cert. No. 151253, IPC: E02F Mar. 14, 1961).

The disadvantages of this machine are large overall dimensions and low maneuverability in the transportation and working positions, as well as a complex process of moving the working machinery into and out of the trench, the above disadvantages becoming especially serious when working deep trenches, including those whose bottom is located much lower than the lower generatrix of the pipeline. For this reason, the known machine cannot practically be applied for working the aforementioned deep trenches in repair of pipelines in the trench without lifting them. Furthermore, in the case of a spontaneous shallowing out of the operating element as a result of interaction with the difficult-to-work soil, running of the contour follower carriage off the pipeline and damage of the latter is possible. The non-rated load on the pipeline from the carriage wheels, can lead to pipeline damage. Here, the carriage wheels are applying inadmissibly high specific pressures to the pipeline, in view of the small surface of contact with the latter, and do not allow increasing the angle of contact with the pipeline up to 180 degr. in view of their large dimensions.

Known is an operating element incorporating a chain portion with the drive shaft, made in the form of a connected to the frame and machine transmission inner shaft, connected to the frame and chains by a chain portion outer shaft which is mounted on the inner shaft with the capability of displacement along it; cross-piece movable in a through opening of the frame of the chain portion, and power drive. Unlike the claimed element, the known operating element comprises arms mounted with the ability of turning about the axis of the drive shaft and connected to the cross-piece, whereas the power drive is connected to the frame of the chain portion and to one of the arms (USSR Auth. Cert. No.306230, IPC: E02F May 6, 1969).

The disadvantage of the known operating element are the limited functional capabilities, in view of the absence of the second chain portion and the slope-forming mechanism.

The closest to the claimed one is the operating element incorporating two chain portions with coaxial drive shafts connected to the frame and transmission of the machine, and the slope-forming mechanism made in the form of two back-slopers connected by their ends to the tension shafts of chain portions and to the mounted on the frames of the latter L-shaped arms which are connected to each other by a tie. Unlike the claimed element, in the known operating element, the tie is made of a fixed length, whereas the drive shaft is made in the form of a common shaft (USSR Auth. Cert. No.280340, IPC: E02F Mar. 13, 1968).

The disadvantage of this operating element is the impossibility of changing the spacing of the chain portions, this, in particular, not permitting the operating element to be used for uncovering pipelines of different diameter.

SUMMARY OF THE INVENTION

The goal of the invention is in the machine for uncovering a pipeline to reduce its overall dimensions and improve its maneuverability by upgrading the working machinery, in order to provide the capability of lifting and folding it into the transportation position and shifting back and forth the center of turn of the base underframe. By eliminating the support on the trench bottom due to availability of a power drive for turning of the frame with the device for clearing away earth in the vertical plane and the ability of forced rotation of the operating element, increase the depth of entering of the latter under the pipeline and simplify its moving into and out of the trench. In specific cases of the invention embodiment, the basic technical results are enhanced and achievement of additional technical results is ensured, which consist in reduction of the loads on the pipeline from the contour follower, facilitation of turning of the base underframe in the working position, simplifying the movement of the working machinery into the transportation position and back, achievement of a more symmetrical location of the trench relative to the pipeline and automatic orientation of the working machinery with respect to the pipeline, simplifying the design of the device to control the position of the working machinery, achievement of a high accuracy of digging under the pipeline and control of the height of the earth layer above the pipeline to eliminate the possibility of pipeline damage.

The above goal is achieved by that in the machine for uncovering a pipeline, comprising the base underframe and the working machinery including a frame with a device for clearing away earth, which is hinged to the base underframe with the ability of turning in the horizontal and vertical planes, an operating element which is made in the form of chain portions mounted on the frame with the device for clearing away earth, a contour follower made in the form of a support on the pipeline, which is hinged with the ability of turning in the horizontal and vertical planes, and a device to control the position of the working machinery with respect to the pipeline, according to the invention, the working machinery is fitted with the power drive for turning in the vertical plane of the frame with the device for clearing away earth and a means of securing the latter against turning in the horizontal plane, the contour follower is fitted with an arm which is mounted on a hinge with the ability of turning in the vertical plane and which carries the above support on the pipeline, and a means for locking the above arm, the operating element is fitted with a power drive, whereas its chain portions are mounted with the ability of turning in the vertical plane about the axis of the drive shaft by means of the aforementioned power drive of the operating element.

Small overall dimensions and high maneuverability of the machine in the transportation position are provided due to lifting and folding the working machinery with its placement in the transportation position essentially above the base underframe. The ability of the machine maneuvering by shifting forward and backward the center of turn of the base underframe and alternative turning of the latter, increases the machine maneuverability in the transportation position. The absence in the machine of the support on the ground (trench bottom) located behind the operating element, allows a deeper entering of the operating element under the pipeline. The ability of a forced rotation of the operating element simplifies the working machinery moving into and out of the trench, thus enhancing the machine mobility and maneuverability.

In specific cases of embodiment of the machine, the frame with the device for clearing away earth is provided with at least one support on the ground located in front of the operating element and is connected to the base underframe with the ability of turning in the horizontal plane on an additional axis. This provides the machine maneuverability due to shifting forward/backward of the center of turn of the base underframe without the pipeline loading.

Furthermore, the support on the ground is fitted with a power drive and is mounted with the ability of linear displacement along the longitudinal axis of the working machinery, by means of the above power drive of the support on the ground. This facilitates turning of the base underframe in forward motion.

Furthermore, the means for securing the frame with the device for clearing away earth against turning in the horizontal plane incorporate a power drive for turning of the above frame. As a results, turning of the base underframe in machine maneuvering is facilitated and moving of the working machinery into the transportation position is simplified.

Furthermore, at least part of the arm of the contour follower, on which the support on the pipeline is fastened, is mounted with the ability of turning in the horizontal plane. This leads to an increase in the machine maneuverability due to increase of the admissible angle of the working machinery skewing with respect to the pipeline, reduction of the lateral loads on the pipeline and improvement of the quality of the machine operation by ensuring a more symmetrical location of the trench relative to the pipeline.

In addition, the outputs of the device to control the position of the working machinery with respect to the pipeline, are connected to the inputs of the device for control of the power drive for turning in the horizontal plane of the frame with the device for clearing away earth. Automatic orientation of the working machinery in the horizontal plane relative to the pipeline is thereby provided.

Furthermore, the arm of the contour follower is mounted on the operating element, whereas the means for locking the above arm are made in the form of a power drive for its turning. This results in a reduction of the machine overall dimensions in the transportation position, simplification of the arm moving into the transportation position and back, as well as of the design of the device to control the position of the working machinery with respect to the pipeline. Furthermore, pressing down of the support on the pipeline with a rated force by means of a power drive of the contour follower, irrespective of the position of the operating element, improves the reliability and safety of the machine operation.

In addition, the operating element is fitted with a cross-piece movable in the through holes of the frames of its chain portions, and the elements for locking the cross-piece relative to the above frames, here the arm and the power drive of the contour follower, are mounted on the above cross-piece. As a consequence, the contour follower is not an obstacle to changing the spacing of the chain portions of the operating element. Here, the most compact design of the working machinery is provided.

Furthermore, the support on the pipeline of the contour follower, is made as a slide block whose base has the form of part of the outer surface of the pipeline, whereas its front part has the form of a wedge, here an opening is provided in the slide block along its longitudinal axis, whereas its rear end face carriers the spring-loaded rippers located opposite to the opening.

Thereby the capability is provided of embracing the pipeline by up to 180 degr. angle, transferring a great load on the pipeline at low specific pressures, passing over the air escape valves available in the pipeline upper part, as well as working the soil under the pipelines with minimal consumption of the tractive force of the base underfrome for it.

In addition, the outputs of the device to control the position of the working machinery with respect to the pipeline, are connected to the inputs of the device for control of the power drive of the operating element. An automatic maintenance of the assigned depth of the operating element with respect to the pipeline is thereby provided.

Furthermore, the device to control the position of the operating element with respect to the pipeline, is made in the form of a computer with an input device, sensors of the angles of the working machinery rotation, connected to the computer inputs, and means of signaling the position of the working machinery relative to the pipeline, connected to the computer outputs. An accurate control of the position of the working machinery relative to the pipeline is thereby provided in any modification of the machine.

A goal of the invention is in the operating element, by its upgrading to provide the capability of changing the spacing of the chain portions, to expand the area of the operating element application, for instance for uncovering pipelines of different diameter or digging trenches of different width.

The above goal is achieved by that the operating element comprising two chain portions with coaxial drive shafts connected to the frame and transmission of the machine, and slope-forming mechanism made in the form of two back slopers connected with their ends to the tension shafts of the chain portions and to the mounted on the frames of the latter L-shaped arms which are connected to each other by a tie, according to the invention, is fitted with a power drive, here the drive shaft of each chain portion is made in the form of an inner shaft which is connected to the frame and the machine transmission, an outer shaft which is connected to the frame and chains of the chain portion and is mounted on the inner shaft with the ability of displacement along it, and, at least two split distance sleeves located between the bearing supports of the inner and outer shafts, which are fitted with fasteners-for accommodating the removable power drive, whereas the above tie of the slope-forming mechanism is made to be telescopic with a lock of its inner and outer elements.

Thereby, a capability is provided of changing the spacing of the chain portions, and the area of application of the operating element is widened, for instance to include uncovering of pipelines of different diameter or digging trenches of different width.

BRIEF DESCRIPTION OF THE DRAWINGS

Other parts and features of the invention will become obvious from the following description of its specific embodiments, with references to the accompanying drawings, in which:

FIG. 1 represents the claimed machine for uncovering a pipeline, side view;

FIG. 2 is the working machinery in the transportation position, side view;

FIG. 3 is component A in FIG. 1;

FIGS. 14, 15 are the block-diagram of the device to control the position of the working machinery with respect to the pipeline with the devices for control of the power drives of the working machinery;

FIG. 18 is the first embodiment of the contour follower;

FIG. 19 is section M—M in FIG. 18;

FIG. 20 is the electric circuit of an embodiment of the device to control the position of the working machinery with respect to the pipeline with the devices for control of the power drives of the working machinery;

FIG. 21 is the second variant of the contour follower

FIG. 22 is the geometrical schematics of the working machinery with the second variant of the contour follower in the horizontal plane;

DESCRIPTION OF THE EMBODIMENTS OF THE INVENTION

Figure 4:
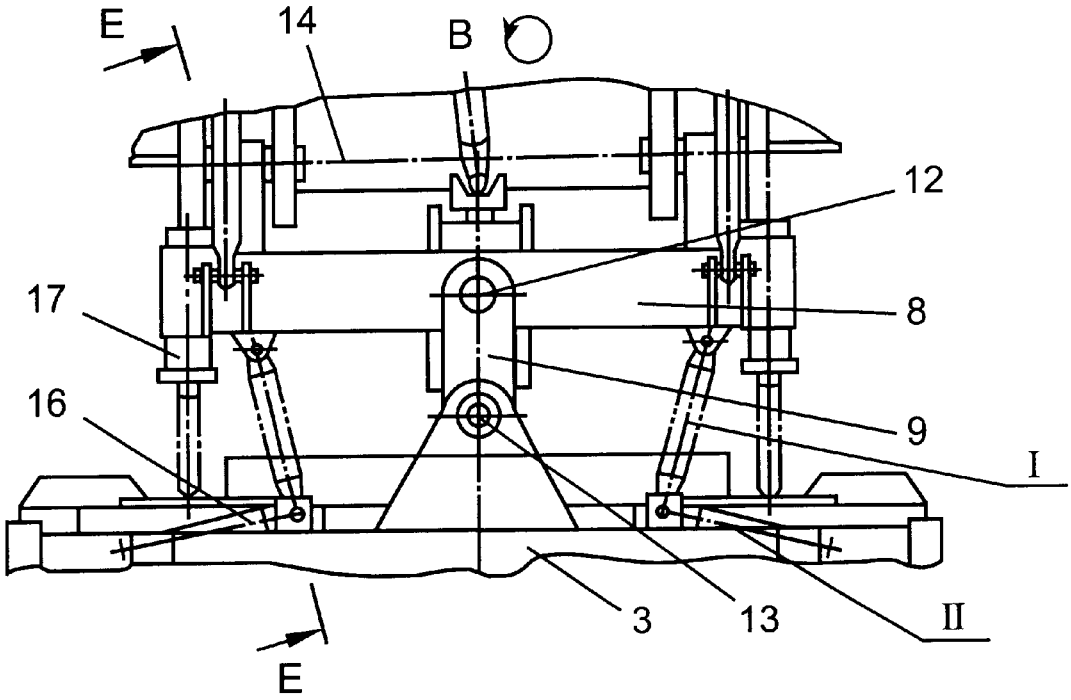
FIG. 4 is component B in FIG. 1.
Figure 5:
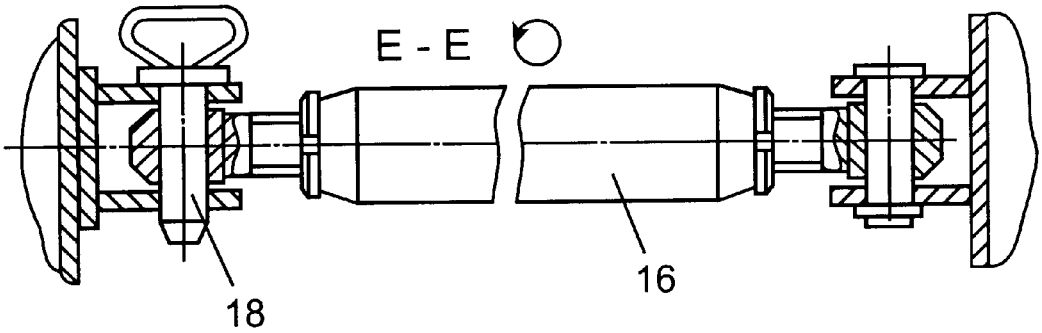
FIG. 5 is section E—E in FIG. 4.

The claimed machine for pipeline uncovering in the main embodiment (FIG. 1) comprises base underframe 1 and working machinery 2 including frame 3 with a device 4 for clearing away earth, operating element 5, contour follower 6 and device to control the position of working machinery 2 with respect to pipeline 7.

Device, 4 for clearing away earth can be made in the form of a container or, for instance, blade thrower 4, whereas frame 3 in the form of case 3 of above thrower 4. Here, working machinery 2 is fitted with lifting frame 8, upper 9 and lower 10 lugs by which case 3 is hinged to rear part of frame 11 of base underframe 1 with the ability of turning in the horizontal plane on vertical axes 12, 13 and in the vertical plane (plane of drawing in FIG. 1) on horizontal transverse axis 14. Working machinery 2 incorporates power drive for turning of lifting frame 8, and together with it, also of all working machinery 2, on axis 14 when lifting or lowering the latter into the transportation position I (FIG. 1, 2) or working position II (FIG. 1), respectively, which is made in the form of lifting hydraulic cylinders 15. Furthermore, working machinery 2 incorporates a means for securing case 3 against turning in the horizontal plane on axes 12, 13 when switching it into the transportation position, which are made in the form of spacers 16 and a power drive which has the form of locking hydraulic cylinders 17. Each spacer 16 is hinged with one end to the front end face of case 3, and at the other end has a lug with an opening for the index finger 18 by means of which spacer 16 in the machine working position is fixed on case 3, and in the transportation position is connected to the lifting frame 8 (FIG. 4, 5). Cases of locking hydraulic cylinders 17 are rigidly fastened on lifting frame 8, whereas the rods are made with spherical end faces for resting against the front end face of case 3.

Figure 24:
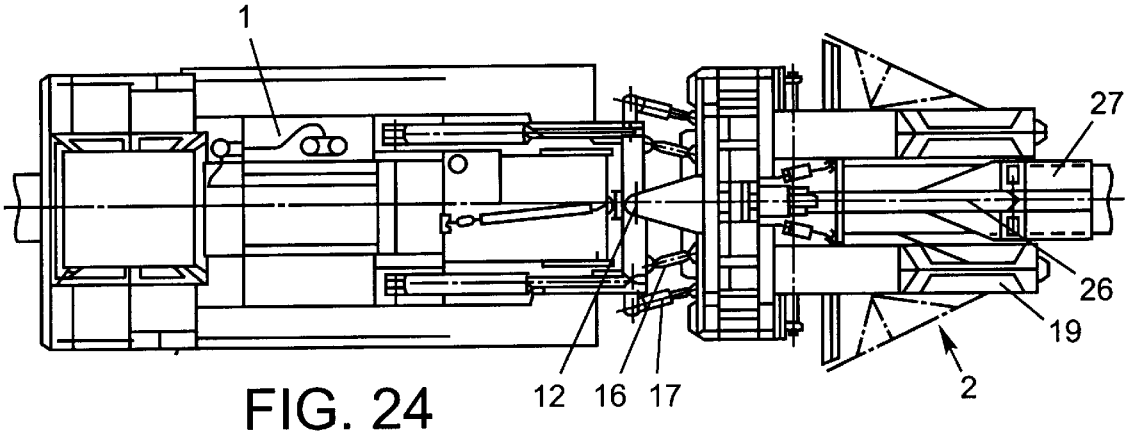
FIG. 24 is the same, top view.
Figure 25:
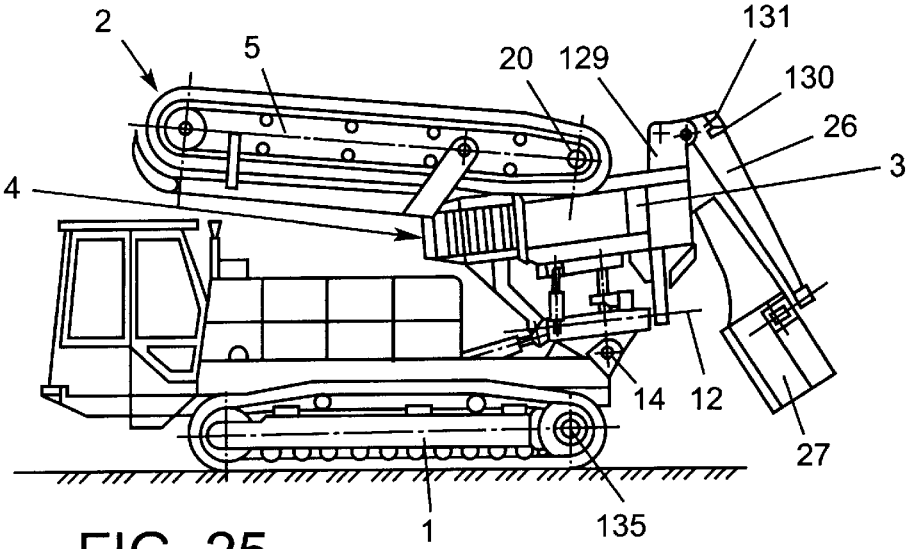
FIG. 25 is the same in the transportation position, side view.

The above-mentioned horizontal plane is understood to be the plane in which the support surface of caterpillar travel unit of base underframe 1 is located, whereas the vertical plane is the plane normal to the horizontal plane and parallel to the longitudinal axis of the machine (FIG. 24).

Figure 6:
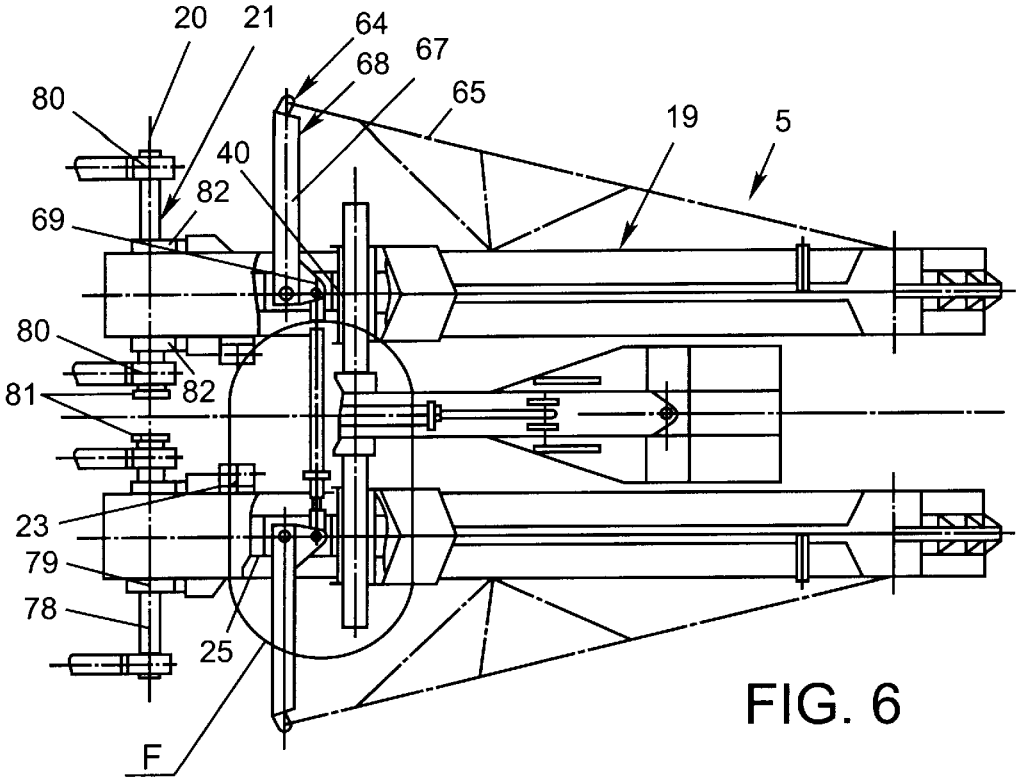
FIG. 6 is the operating element with the contour follower, top view.
Figure 17:
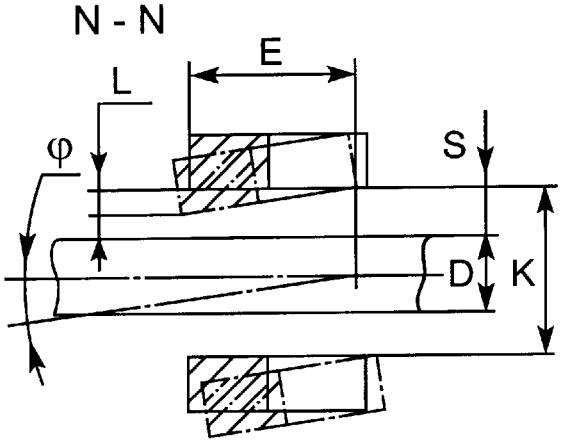
FIG. 17 is section N—N in FIG. 16.

Operating element 5 comprises two parallel chain portions 19 located symmetrical to its longitudinal axis "a—a" (FIG. 6) and spaced at distance K which is larger than pipeline diameter D by the size of two gaps S (FIG. 17), and mounted on the rear end face of case 3 with the ability of turning in the vertical plane on axis 20 of coaxial drive shafts 21. Here, operating element 5 is fitted with power drive for turning of chain portions 19, which is made in the form of hydraulic cylinders 22 of operating element, connected by spherical hinges to bracket 23 of case 3 and brackets 24 of frames 25 of chain portions 19.

Contour follower 6 is made in the form of arm 26 and support on the pipeline which is made in the form of slide block 27 hinged at the end of arm 26 with the ability of turning in the horizontal and vertical planes on axes 28 and 29 normal to each other.

Figure 7:
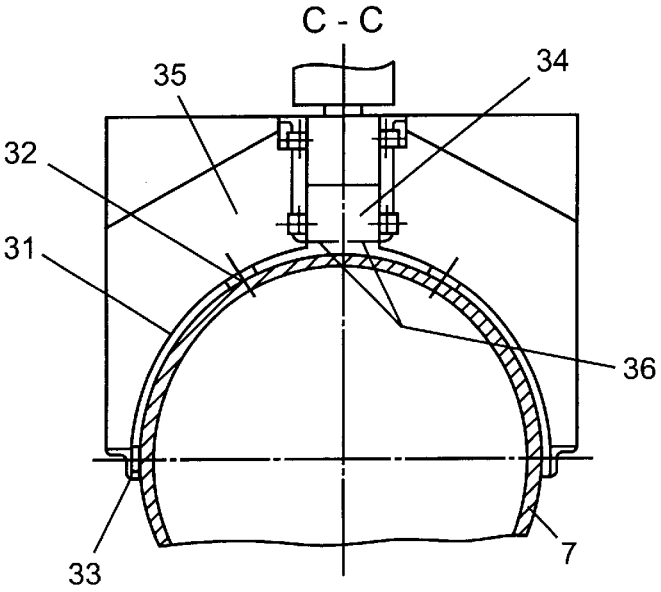
FIG. 7 is section C—C in FIG. 1.

Front part of slide block 27 is made in plan in the form of wedge 30 for working the soil above the pipeline and moving it to the side of chain portions 19. Slide block 27 has cylindrical base 31 with 180 degr. angle of embracing the pipeline, which carries removable skids 32, 33 (FIG. 7). Longitudinal axis "b—b" of cylindrical base 31 of slide block 27, when skids 32, 33 are mounted on pipeline 7, coincides with its longitudinal axis. Here, for passing over air release valves, in base 31 and in the part of slide block 27 located above the base, opening 34 is made along longitudinal axis "b—b", and mounted on rear end face 35 of slide block 27 are spring-loaded rippers 36 which are located opposite to opening 34 with a small gap with the upper surface of pipeline 7. Rippers 36 are made of torsion type in the form of Z-shaped spring elements. Support on the pipe can be made in the form of a carriage or other travel unit for displacement over pipeline, the slide block, however, having the simplest and most compact design and providing the lowest specific pressure on the pipeline.

Figure 9:
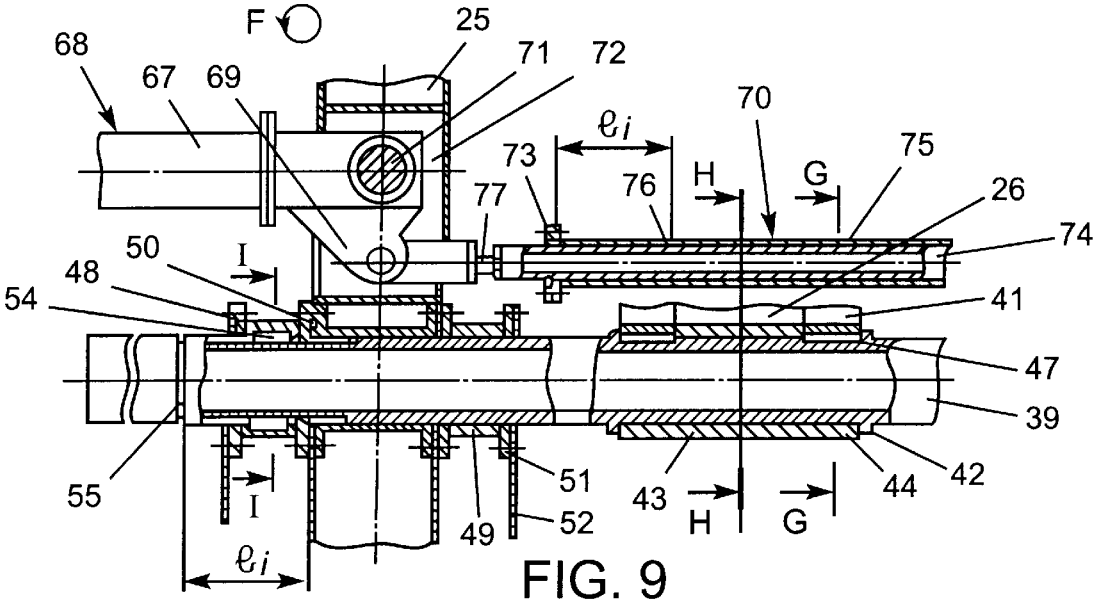
FIG. 9 is component F in FIG. 6.
Figure 10:
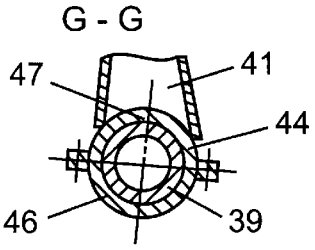
FIG. 10 is section G—G in FIG. 9.
Figure 11:
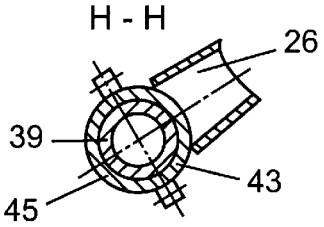
FIG. 11 is section H—H in FIG. 9.
Figure 12:
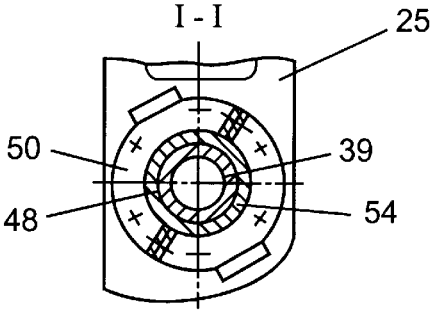
FIG. 12 is section I—I in FIG. 9.

Arm 26 of contour follower 6 is hinged to operating element 5 with the ability of turning in the vertical plane on horizontal transverse axis 37, thus providing the smallest length of the machine in the transportation position (FIG. 2) at the expense of contour follower 6 being accommodated within the overall dimensions of operating element 5. Contour follower is fitted with means of securing arm 26 against turning on axis 37, which are made in the form of a power drive which is hydraulic cylinder 38. Here, operating element 5 is fitted with cross-piece 39 which is movable in the through holes 40 of frames 25 of chain portions 19 and which carries arm 26 and bracket 41 to which case of hydraulic cylinder 38 is hinged, whose rod is hinged to arm 26. Cross-piece 39 is made of a cylindrical pipe which has collars 42 located between which are embracing cross-piece 39 hubs 43, 44 of arm 26 and bracket 41. Hubs 43 and 44 are made detachable in the center plane with removable covers 45, 46 (FIG. 10, 11). Here, hubs 44 of. bracket 41 are fixedly connected to cross-piece 39 by keys 47. Operating element 5 is fitted with elements for locking cross-piece 39 with respect to frames 25, which are made in the form of detachable in plan sleeves 48, 49 with flanges 50, 51 which are bolted to frames 25 and brackets 52 of dressing shoes 53. Sleeves 48 are fixedly connected to cross-piece 39 by keys 54, while their flanges 50 enter grooves 55 made on cross-piece 39 (FIG. 9). Distance $I_i$ between adjacent grooves 55 is equal to half of the difference in diameters $D_i$ and $D_{i+1}$ of two pipelines of i-th and (i+1) numbers, arranged in ascending order by their diameters. Tie 56 is hinged to slide block 27 for securing slide block 27 on arm 26 from turning on axes 28, 29 in the transportation position. Here, holes for index finger 59 are made in tie 56 and in lugs 57, 58 mounted on arm 26 and slide block 27.

Case 3 is fitted with supports on the ground, which are made in the form of skids 60 located in front of operating element 5 and hinged with the ability of turning in the vertical plane, to arm 61 and brace 62 which are hinged to case 3 (FIG. 1).

Figure 8:
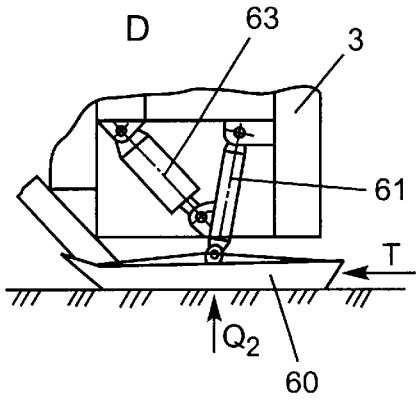
FIG. 8 is a variant of component D in FIG. 1.

FIG. 8 shows a variant of the component for mounting skids 60, in which the latter are fitted with power drives made in the form of hydraulic cylinders 63. Here, each skid 60 is hinged to the end of arm 61 which is hinged to rod of hydraulic cylinder 63 whose case is hinged to case 3. Other variants of mounting skids 60 with the ability of linear displacement along the longitudinal axis of working machinery 2, are possible, namely in the slides (not shown in the drawing).

Figure 13:
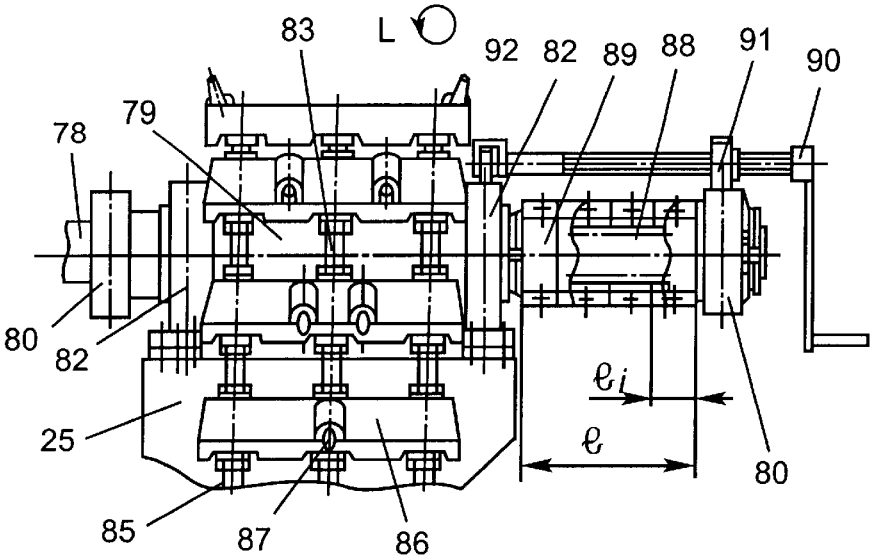
FIG. 13 is view L In FIG. 1.

Operating element 5 includes slope-forming mechanism 64 made in the form of two flexible, for instance chain back-slopers 65 whose ends are connected with an eccentricity to tension shafts 66 of chain portions 19, whereas the other ends are connected to the ends of long levers 67 of L-shaped arms 68 whose short levers 69 are connected to each other by tie 70. Arms 68 by means of axles 71 are fastened to the upper parts of frames 25 in which through openings 72 are made for arms 68 and ties 70 which are made telescopic with lock 73 of their inner and outer tubular elements. Lock 73 is made in the form of split flange 73 located in one of grooves 76 made in inner element 74 at distance $I_i$ from each other, and is bolted to flange of outer element 75. Inner 74 and outer 75 elements have screw-type devices 77 for adjustment of their length. Drive shaft 21 of each portion 19 is made composite, of inner 78 and outer 79 shafts connected to each other by spines with the ability of axial linear displacement I (FIG. 13) equal to half of the difference of the largest and smallest diameters of the uncovered pipelines. Inner shaft 78 by means of bearing supports 80 is mounted on rear end face of case 3 and is connected to the machine transmission by a geared half-coupling 81. Outer shaft 79 by means of bearing supports 82 is connected to the end face of frame 25. Outer shaft 79 supports three sprockets 83 which together with sprockets 84 of tension shaft 66 carry three plate bushing-roller chains 85 bending to one side. Fastened on chains 85 are earth-transporting beams 86 with cutters 87, which connect chains 85 into one chain structure. In order to secure outer shaft 79 against axial displacement and prevent from contamination spline section 88 of inner shaft 78, the latter carries n distance sleeves 89 whose number n is smaller than number m of dug-under pipelines by a unity. Length $I_i$ of i-th distance sleeve 89 corresponds to the lengths of i-th sections of cross-piece 39 and inner element 74 between adjacent grooves 55 and 76. Distance sleeves 89 are located between bearing supports 80 and 82 and are made split, detachable in the centre plane. For moving apart or moving together chain portions 19, operating element 5 is fitted with detachable manual power screw drive 90, bearing supports 80, 82 being fitted with fasteners 91, 92 for mounting power drive 90 on them.

Figure 16:
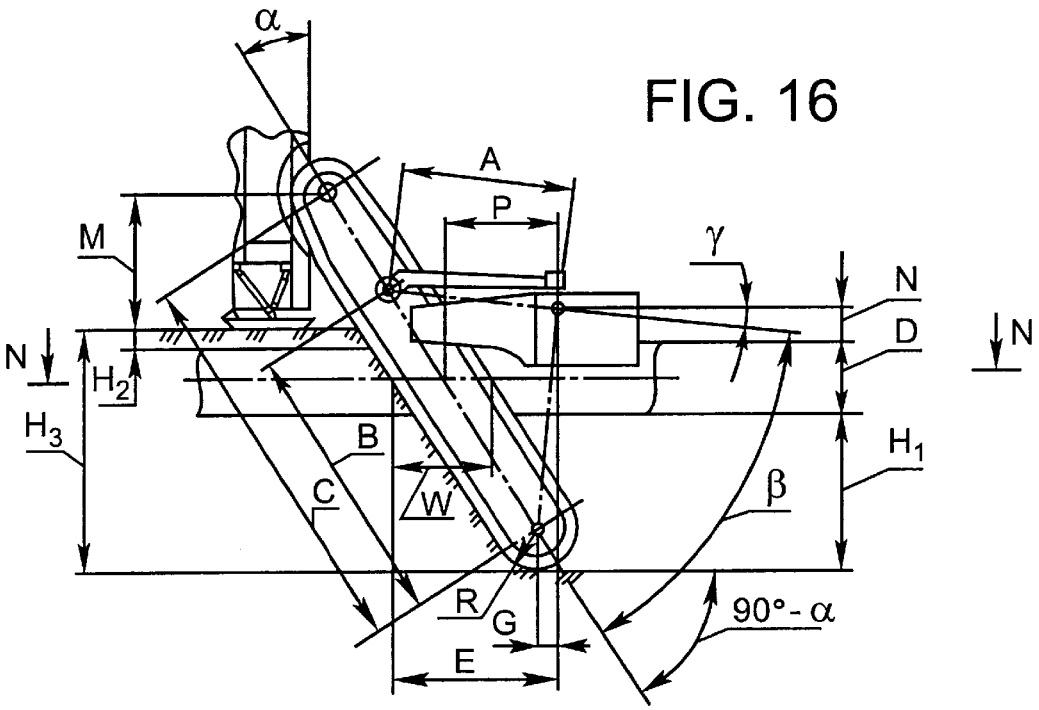
FIG. 16 is the geometrical schematics of the working machinery in the vertical plane.

Device to control the position of working machinery 2 with respect to pipeline 7 can have different embodiments. For instance, if distance G along the horizontal (FIG. 16) between the axis of tension shaft 66 and axis 29 of turn of contour follower 27 relative to arm 26 is equal to zero or is negligible, turning of working machinery 2 on axis 29 with change of height $H_2$ of the layer of earth above the pipeline does not practically affect the value of depth $H_1$ of operating element 5 entering under pipeline 7. In this case depth $H_1$ depends only on angle β (FIG. 16) between operating element 5 and arm 26, whose required value can be maintained by simple means. For instance, by means of a stop or flexible tie-rod (not shown in the drawing) for limiting the turning of arm 26 on axis 37, no monitoring of angle β being required here. If arm 26 is only secured against turning on axis 37 by hydraulic cylinder 38 which provides a rated force of pressing slide block 27 to pipeline 7 by limiting the pressure of working liquid in its piston cavity, the device to control the position of working machinery can be made in the form of, for instance, limit switches mounted on arm 26 between posts 93 of slide block 27 and with their contacts SQ7, SQ8 (FIG. 20) connected into the electric circuits of signal lamps HL3, HL4 "Insufficient depth" and "Excess depth", by whose signals the operator manually controls hydraulic cylinders 22 of operating element. Furthermore, the above limit switches can have contacts SQ3 and SQ4 which are connected into electric circuit, of electric magnets Y1, Y2 of electrohydrauiic distributors 116, 117 of control of hydraulic cylinders 22 of operating element for controlling the latter in the automatic mode (FIG. 20).

Here, in order to control the displacement of the operating element relative to the pipeline in the horizontal plane, the device to control the position of the working machinery incorporates limit switches whose contacts SQ1, SQ2 are connected into the electric circuits of signal lamps HL1, HL2 "Deviation to the left", "Deviation to the right" (FIG. 20).

Figure 14:
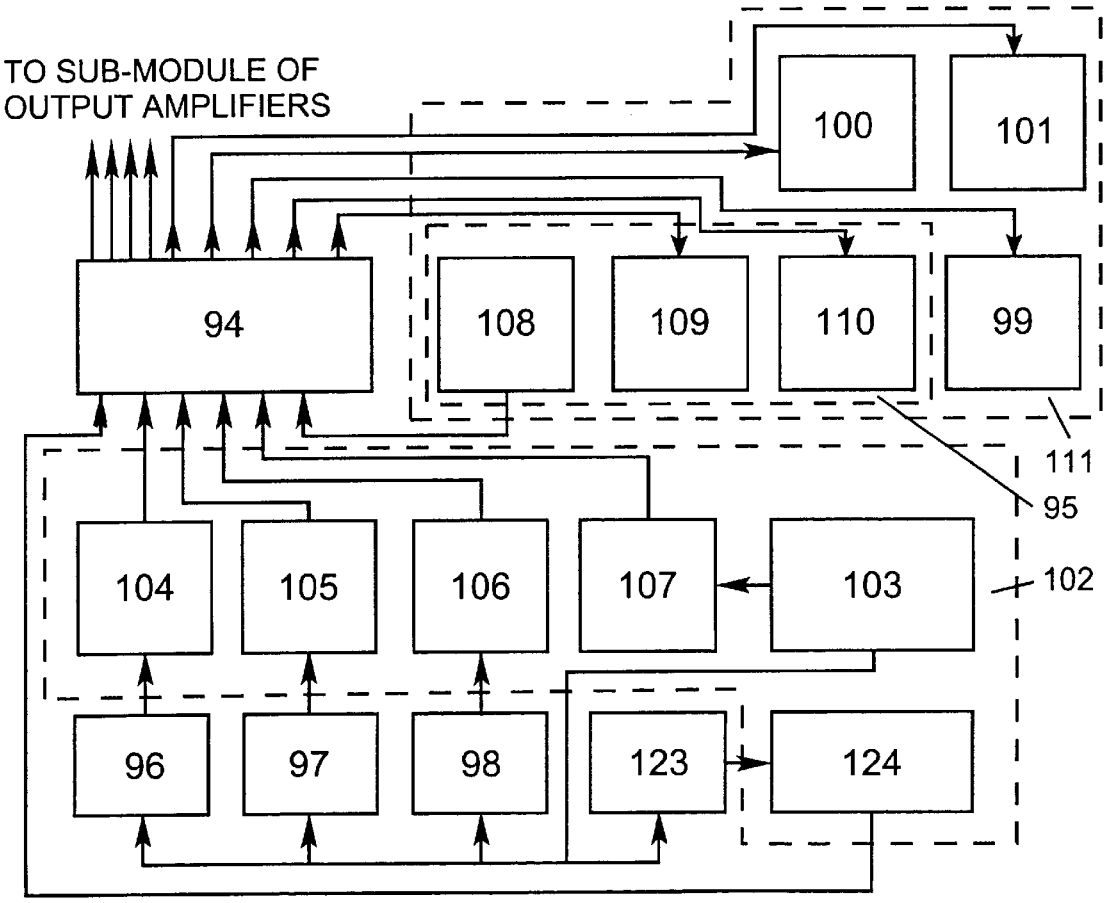

In the general case with any value of distance G, the machine control can be provided by the device to control the position of the working machinery, made in the form of a computer 94 with the input device 95, sensors 96, 97, 98 of angles α,β, Φ of rotation (FIG. 16, 17) of working machinery and signaling means 99, 100, 101 of the position of the working machinery relative to the pipeline, connected to the outputs of computer 94 (FIG. 14). Computer 94 can have the form of an onboard computer 94 of base underframe 1, which is designed to consist of three boards, namely processor board, board of input/output ports, and analog-digital converter board. Sine-cosine synchro resolvers BVT-D can be used as sensors 96, 97, 98 of angles α,β, Φ of rotation, the device in this case having signal preprocessing submodule 102 incorporating master oscillator 103 connected to the inputs of sensors 96, 97, 98 and amplitude detectors 104, 105, 106, 107 whose inputs are connected to the outputs of sensors 96, 97, 98 and master oscillator 103, and their outputs are connected to the inputs of the onboard computer 94. Input device 95 comprises a keyboard 108 with keys and toggle switches for storing in the memory of computer 94 D and $H_1$ settings and selection of the operational mode, which is connected to the input of computer 94, and panels 109, 110 of D and $H_1$ settings, connected to the outputs of computer 94. Signaling means 99, 100, 101 are made in the form of a pane of $H_1$,$L_1$, $H_2$ parameters. Panels 99, 100, 101, 109, 110 can be made on the basis of numerical or scale semi-conductor indicators.

Keyboard 108 and panels 99, 100, 101, 109, 110 are designed as one control and indication panel 111 which is mounted on the frame of the windscreen in the cabin of the base underframe 1 directly in front of the operator.

In order to provide automatic control of hydraulic cylinders 22 of operating element, the device incorporates submodule 112 of output amplifiers 113, 114 whose inputs are connected to outputs of computer 94, whereas their outputs are connected to the inputs of device 115 for control of hydraulic cylinders 22, which is made up by electrohydraulic distributors 116, 117 of hydraulic cylinders 22 with electric magnets Y1, Y2.

An embodiment of contour follower 6 in FIG. 18 is characterized in that arm 26 is made of two links (parts) 118, 119 hinged to each other with the ability of reciprocal turning in the horizontal plane on axis 120 which is parallel to axis 28 of rotation in the horizontal plane of contour follower 27. Here, axis 120, at least in one working position of working machinery 2 passes through point O which is the point of intersection of longitudinal axis "a—a" of operating element 5 with the horizontal plane in which longitudinal axis "b—b" of contour follower 27 is located. The above working position is determined by average height $H_2$ of the earth layer above the pipeline.

In this case the device to control the position of the working machinery can be made simple enough in the form of switches 121, 122. Contacts SQ5, SQ6 of switch 121 are connected into the electric circuits of electric magnets Y3, Y4 of electric distributors 127, 128 of locking hydraulic cylinders 17, whereas contacts SQ1, SQ2 of switch 122 are connected into electric circuits of signal lamps HL1, HL2 <<Deviation to the left>>, <<Deviation to the right)>>.

The embodiment of contour follower 6 in FIG. 21 differs from the first variant by that axis 120 is located with a shift F relative to the above point O. Here, the device to control the position of the working machinery (FIG. 14, 15) includes additional sensor 123 of angle ψ of rotation of links 118, 119 of arm 26, amplitude detector 124 and output amplifiers 125, 126 whose outputs are connected to electric magnets Y3, Y4 of electrohydraulic distributors 127, 128 of locking hydraulic cylinders 17. In this case, position of axis 120 relative to point O can be any position, here arm 26 can be made of one link which is mounted on cross-piece 39 by means of a spherical hinge or Hooke's joint (not shown in the drawing).

Figure 23:
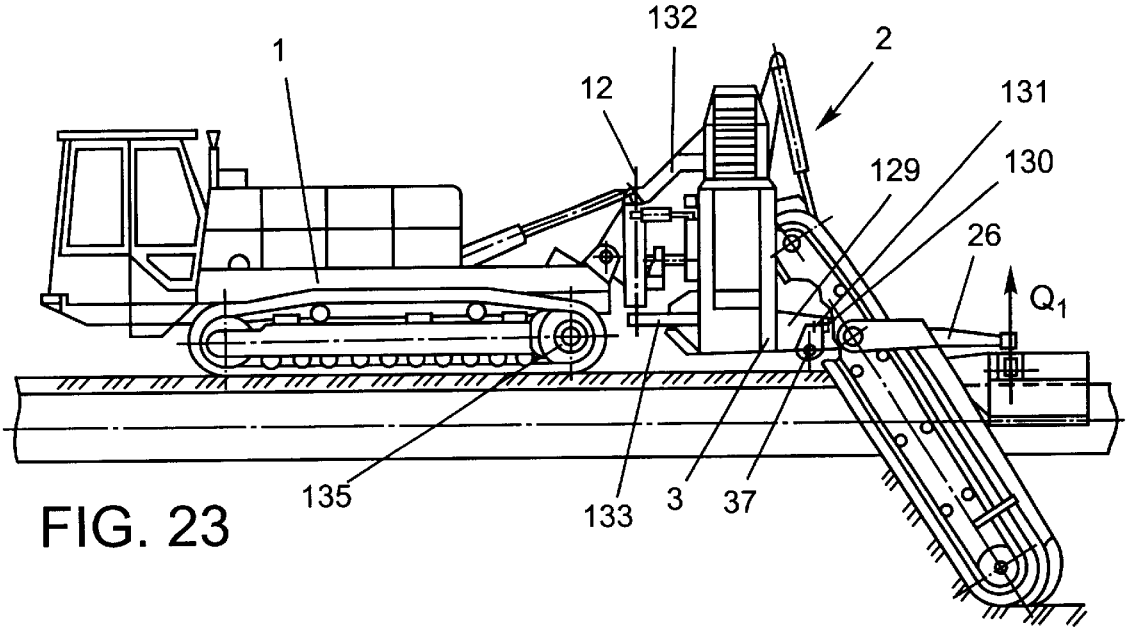
FIG. 23 is an embodiment of the claimed machine, side view.

The claimed machine can have an embodiment (FIG. 23, 24, 25) differing from the basic embodiment in that arm 26 of contour follower 6 is hinged on bracket 129 which is made on the lower part of rear end face of case 3.

Here, means for securing arm 26 against turning on axis 37 are made in the form of stops 130 provided on side surfaces of arm 26 and positioned with the ability of contacting the end face of bracket 129 in the working position of arm 26, and index fingers 131 located in the coaxial in the working position of arm 26 holes made in arm 26 and bracket 129. Index fingers 131 can have a drive for their displacement in locking or unlocking of arm 26. This embodiment of the machine may not have skids 60 and lugs 9, 10; here lifting frame 8 is hinged to upper 132 and lower 133 brackets provided in the front end face of case 3. Furthermore, tie 56 may be absent.

DESCRIPTION OF THE INVENTION USE

The Claimed Machine for Uncovering of Pipelines (basic embodiment) Operates as Follows The machine is positioned in the place chosen for work performance, at a small section of pipeline uncovered manually or using other mechanisms. Working machinery 2 is shifted from working position (I in FIG. 1, 2) into working position (II in FIG. 1), while bringing down lifting frame 8 by means of lifting hydraulic cylinder 15 until skids 60 rest on the ground. Spacers are unlocked and fastened on case 3 (in position II in FIG. 4) and rods of locking hydraulic cylinders 17 are drawn in. Hydraulic cylinders 22 are used to lower operating element 5, not letting it come down to the ground by 10 to 15 cm, tie 56 is unlocked and shifted from transportation position (I in FIG. 3) into working position (II in FIG. 3), with fixing it on lugs 58 by index finger 59. Hydraulic cylinder 38 is used to lower arm 26, until slide block 27 rests on pipeline 7 and machine motion is started, with simultaneous smooth entering of operating element 5 into the earth. Here, slide block 27 by means of hydraulic cylinder 38 is pressed to pipeline 7 with rated force $Q_1$ equal to 20 kN, which is automatically maintained constant by limiting the pressure of working liquid in hydraulic cylinder 38, irrespective of load on operating element 5 or its position relative to pipeline 7.

Control of base underfrome 1 along the route is performed by operator by indications of panel 100, maintaining displacement L within S/2 tolerance. Control of entering of operating element 5 in the manual mode is performed by the operator by indications of panel 99, maintaining depth $H_1$ of operating element 5 under pipeline 7, equal to the required one. Control of height $H_2$ of the layer of earth above the pipeline, is performed by the operator by indications of panel 101, stopping the machine operation when height $H_2$ goes beyond the admissible range, thus eliminating the possibility of pipeline damage, as in machine operation at height $H_2$ smaller, than the minimal admissible value, in the case of sagging of the travel unit of base underframe 1 and/or skids 60, the pipeline can be damaged by pipeline travel unit, skids 60 or case 3. In machine operation at height $H_2$ greater, then the maximal admissible one, disturbance of operation of contour follower 6 is possible, and, hence, damage of the pipeline. After the machine has been brought into the working mode by manual control, automatic control is switched on, in which automatic control of hydraulic cylinders 22 is carried out to provide the assigned depth $H_1$.

The device to control the position of working machinery 2 with respect to pipeline 7, shown in FIG. 14, 15, operates as follows:

Control of the position of working machinery 2 relative to pipeline 7 in the vertical plane (FIG. 1, 16) is provided by sensors of angle α of rotation of operating element 5 relative to case 3 and angle β of rotation of arm 26 relative to operating element 5. Here, angles of rotation α, β and γ are connected to each other by a mathematical dependence:

$$\gamma=90°-\alpha-\beta$$

Thus, sensor of angle γ of rotation of slide block 27 relative to arm 26, can be used in the device instead of one of the sensors of angles α or β. Considering, however, the short length of slide block 27 and presence of unevenness (insulation, welds, patches, etc.) on pipeline 7, this is not rational, in view of lowering of the accuracy of $H_1$ and $H_2$ determination.

Sensors 96, 97 are made in the form of sine-cosine synchro resolvers (SCSR), therefore at their output we have the values of voltages $U_1$, $U_2$, proportional to sin or cos of the angle of rotation, i.e.:

$\cos\alpha=U_1/U_{op}$, $\cos\beta=U_2/U_{op}$, $\alpha=\arccos U_1/U_{op}$, $\beta=\arccos U_2/U_{op}$, where $U_{op}$ is the SCSR supply voltage which is measured in each cycle of calculations;

$U_1$ and $U_2$ are the output voltages of sensors 96, 97 of angles α and β.

Calculations are performed by computer 94 by the following mathematical formulas:

$$H_1=B*\cos\alpha-A*\cos(\alpha+,\beta)-N-D+R, \quad (1)$$

$$H_2=(C-B)*\cos\alpha+A*\cos(\alpha+,\beta)+N-M \quad (2)$$

where B is the distance between axis 37 of turning of arm 26 and axis of tension shaft 66;

C is the distance between axes of driven 21 and tension 66 shafts of chain portion 19;

N is the distance along the vertical from axis 29 of slide block turning in the vertical plane up to top of pipeline 7;

R is the radius of chain portion 19;

A is the distance between axes 37 and 29;

M is the distance along the vertical, from axis of drive shaft 21 up to support surface of skids 60.

If required, computer 94 can compute depth $H_3$ of operating element 5 entering the earth by the following formula:

$$H_3C*\cos\alpha+R-M \quad (3)$$

In a specific, aforementioned case, if distance G is equal to zero or is relatively small, sensor 96 of angle a may be absent. Here, depth $H_1$ with a sufficient degree of accuracy, can be calculated by computer 94 by the following formula:

$$H_1\sqrt{A^{2+B^{2-2*A*B*\cos\beta}}}+R-N-D \quad (4)$$

where $\sqrt{A^2+B^{2-2*A*B*\cos\beta}}$ is the distance between axis 29 and axis of tension shaft 66.

If the value of distance G is close to zero, the accuracy of calculation of $H_1$ by formula (4) is higher, than by formula (1). However, in this case also, sensor 96 of angle α is required for calculation of height $H_2$ by the following formula:

$$H_2=C*\cos\alpha-\sqrt{A^{2+B^{2-2*A*B*\cos\beta}}}+N-M \quad (5)$$

The numerical values of $H_1$ and $H_2$ are shown on panels 99, 101.

Control of the position of working machinery 2 in the horizontal plane (FIG. 17) relative to longitudinal axis 134 of pipeline 7 is performed as follows:

Computer 94 is used to calculate deviation L of the front edge of chain portion 1 9 in the horizontal center plane of pipeline 7 (plane of section N—N in FIG. 16) by the following formula:

$$L=E^*\sin\Phi \quad (6)$$

and to show its numerical value on panel 100. In formula (6) size E 10 (FIG. 16, 17), in view of smallness of angle γ (FIG. 16), changes negligibly during the machine operation, therefore, it can be entered into the computer memory as a constant structural dimension, or the computer can calculate it by the following formula:

$$E=A^*\sin(\alpha+\beta)-[D/2+N+A^*\cos(\alpha+\beta)]\times tg\alpha+R/\cos\alpha \quad (7)$$

where:

$A^*\sin(\alpha+\beta)-[D/2+N+A^*\cos(\alpha+\beta)]\times tg\alpha=P$, $R/\cos\alpha=W/2$ SCSR was used as sensor 98 of angle Φ, therefore in formula (7):

$\sin\Phi=U_3/U_{op}$, $\Phi=\arcsin(U_Z/U_{op})$, where $U_3$ is the output voltage of sensor 98 of angle Φ.

During operation, in each measurement cycle the computer, after computation of depth $H_1$ compares the calculated value of $H_1$ with the value of $H_1$ setting. If the difference is beyond the tolerance, a control signal is formed at the computer output, which after amplification by output amplifier 113, or 114, powers the electric magnet of electrohydraulic distributor 116 and 117, which switches hydraulic cylinders 22 for increasing or decreasing the depth of operating element 5.

When the contour follower 6 and device to control the position of the working machinery with respect to the pipeline, are made as shown in FIG. 21 and 14, 15, the machine operates as follows:

By output voltages $U_3$, $U_4$ read from sensors 98, 123, the computer determines angle Φ and angle ψ between the axes of links 118, 119 of arm 26 by the following formulas:

$$\Phi=\arcsin(U_3/U_{op}),\ \psi=\arcsin(U_4/U_{op}).$$

Then computer 94 determines the lateral displacement at point O (FIG. 21) relative to longitudinal axis <<b—b>> of contour follower 27 along horizontal axis y (FIG. 22) which is normal to axis <<b—b>> coinciding with axis 134 of pipeline 7, by the following formula:

$$y=J^*\cos(\alpha+\beta)^*\sin\Phi+\{A^*\sin(\alpha+\beta)-[D/2+N++A^*\cos(\alpha+\beta)]^*tg\alpha-J^*\cos(\alpha+\beta)\}^*\sin(\Phi+\psi) \quad (8)$$

where J is the distance from axis 29 to the point of intersection of axis 120 with the straight line cutting across axes 29, 37;

$J^*\cos(\alpha+\beta)=I$ is the length of section ca in FIG. 22;

$A^*\sin(\alpha+\beta)-[D/2+N+A^*\cos(\alpha+\beta)]^*tg\alpha-J^*\cos(\alpha+\beta)=F$ is the length of section oa in FIG. 22;

$\Phi+\psi=\lambda$ is the angle of skewing of working machinery with respect to the pipeline.

In this case the positive and negative values of angles Φ and ψ of rotation in formula (8) correspond to turning of link 119 relative to contour follower 27 and of link 118 relative to link 119, clockwise and counterclockwise, respectively, in FIG. 22. The positive value of displacement y corresponds to displacement of point O to the right of axis 134 of pipeline 7 in the direction of the machine movement in FIG. 22.

At $y\neq0$, computer 94 generates an output signal which after amplification by output amplifier 125 or 126, powers the electric magnet of electrohydraulic distributor 127 or 128, which simultaneously switches the locking hydraulic cylinders 17 to turning of case 3 clockwise (at $y>0$) or counterclockwise (at $y<0$) in FIG. 22, 24. At $y=0$ the signal at the output of computer 94 is absent, the electric magnets of electrohydraulic distributors 127, 128 are de-energized, and the cavities of locking hydraulic cylinders 17 are locked, here case 3 is secured against rotation in the horizontal plane.

Simultaneously, computer 94 calculates deviation L by the following formula:

$$L=y+R^*\sin\psi/\cos\alpha, \quad (9)$$

which is shown on panel 100.

In the case of embodiment of contour follower 6 and device to control the position of the working machinery with respect to the pipeline as shown in FIG. 18, 20, the machine operates as follows:

In the case of horizontal skewing of link 119 of arm 26 relative to the longitudinal axis of slide block 27 (i.e. at $\Phi\neq0$) contact SQ5 or SQ6 (depending on skewing direction) of switch 121 is closed, thus energizing electric magnet Y3 or Y4 of electrohydraulic distributor 127 or 128 which switches locking hydraulic cylinders 1 7 for turning case 3 in the direction in which angle Φ of above skewing is reduced. At $\Phi=0$ both contacts SQ5 ad SQ6 are open and electric magnets Y3 and Y4 are de-energized. Control of base underframe 1 along the route is performed by the operator by signal lamps HL1, HL2 to which supply voltage is applied when contacts SQ1, SQ2 of switch 122 are closed in the case of skewing ($\psi\neq0$) of links 118, 119 of arm 26. Control of the depth of operating element 5 in the manual mode is performed by the operator by signal lamps HL3, HL4, to which supply voltage is applied after closing of contacts SQ7, SQ8 of the switch controlling angle β (not shown in the drawing). Automatic control of the operating element depth is provided by contacts SQ3, SQ4 of the aforementioned switch.

Embodiment of contour follower 6 shown in FIG. 18, 21, compared to embodiment of FIG. 3, allows elimination of lateral forces application to pipeline 7 and contour follower 27, and improvement in the machine maneuverability due to smaller displacement L at greater angle (ψ in FIG. 19 or λ in FIG. 22) of skewing of working machinery 2 relative to pipeline 7.

The machine maneuvering in the working position under simple conditions (in rectilinear sections of pipeline or in curved ones with a large curvature radius at relatively small deviation L) is performed in the regular manner by turning base underframe 1 in the direction opposite to direction of deviation L. Here, the skidding at the moment of axis 12 turning in the direction of displacement L is compensated by displacement of axis 12 with respect to axis 13 and increase of L within the tolerance limits.

Figure 26:
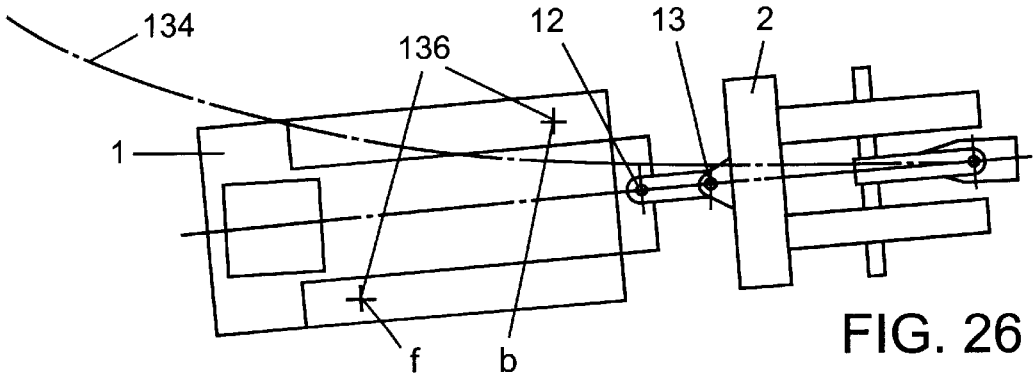
FIGS. 26 to 29 are schematics of the claimed machine during maneuvering.
Figure 28:
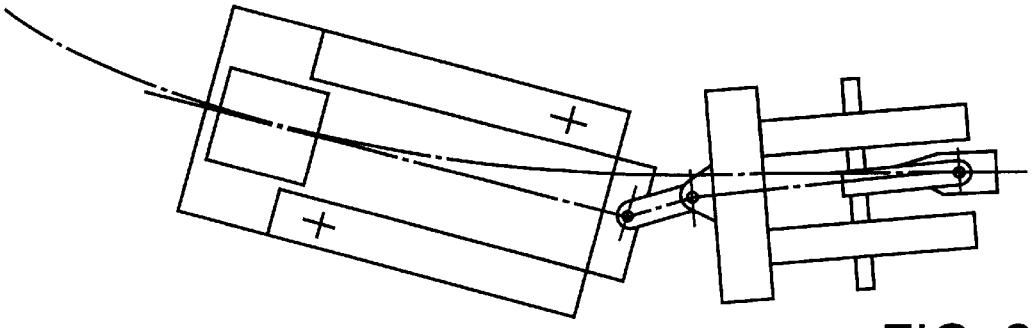
Figure 29:
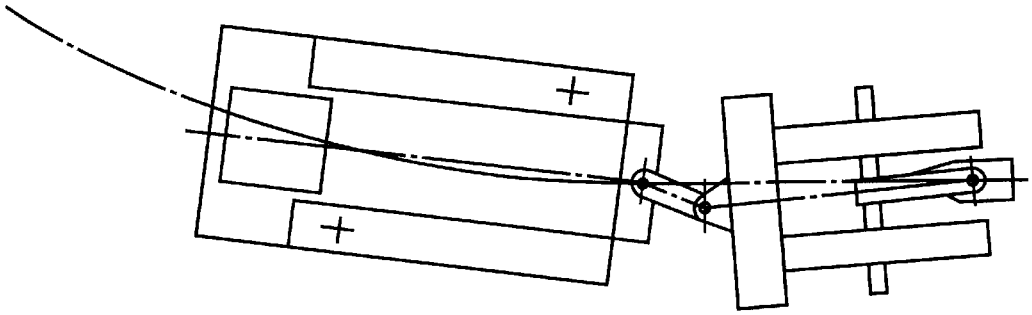

Under critical conditions (in the curved sections with a small radius of curvature at limit deviation L) the machine maneuvering is performed by first turning base underframe 1 in the direction of displacement L with forward shift of the center of turn and subsequent turning in the reverse direction with backward shift of the center of turn. For instance, in the initial position the machine is at the start of a curved section of pipeline with a right turn, with the machine deviation to the left relative to pipeline axis 134 (FIG. 26). In the process of the machine movement the piston cavities of hydraulic cylinders 15, 63 (FIG. 1, 8) are connected to a pressure hydraulic line. Increased in this case is force $Q_2$ of pressing to the ground skids 60 which at this moment are immobile relative to the ground and create additional tractive force T at the expense of hydraulic cylinders 63, which facilitates turning of base underframe 1. Due to increase of force $Q_2$ rear axle 135 of caterpillar travel unit of base underfame 1 is unloaded, and center of turn 136 of the latter is shifted forward into position f. Then base underframe 1 is turned to the left, here axis 12 is shifted to the right (FIG. 27), the rod cavities of hydraulic cylinders 15, 63 are connected to the pressure line, thereby decreasing force $Q_2$ on skids 60 which are brought back to their initial position by means of hydraulic cylinders 63 (FIG. 8), and this results in loading of rear axle 135, whereas the center of turn 136 is shifted backwards into position b, and base underframe 1 is turned to the right (FIG. 28). Thereafter, turning of base underframe 1 to the left (with forward shift of center of turn 136 into position f) through the required angle is performed in a similar fashion, until base underframe 1 is oriented along longitudinal axis 134 of the pipeline (FIG. 29). The availability of two axes of rotation 12, 13 of case 3 relative to base underframe 1, provides the capability of turning of the latter, when skids 60 are pressed to the ground, whereas the movable positioning of skids 60 (FIG. 8) provides the capability of the machine maneuvering during movement. If skids 60 are mounted on case 3 without the ability of linear displacement as shown in FIG. 1, during machine maneuvering pressing of skids 60 to the ground is performed during stops of base underframe 1, whereas its turning with skids 60 pressed to the ground, is performed by backward motion or in place by caterpillar reversal.

Figure 27:
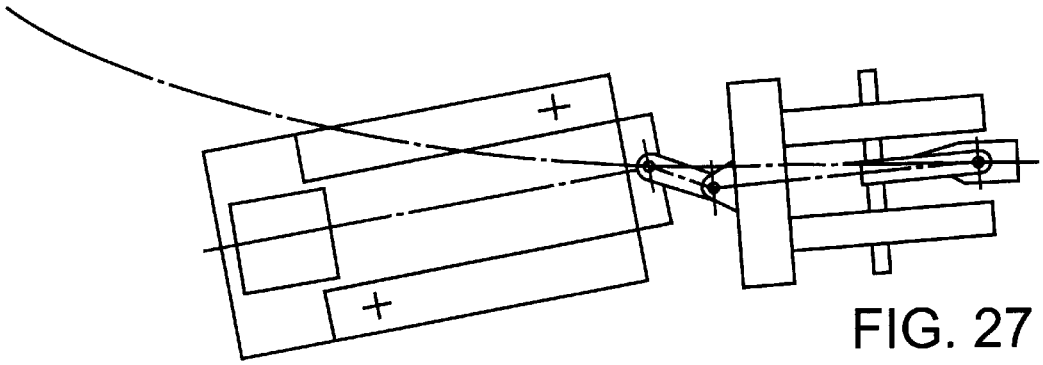

In order to facilitate turning, at the moment of base underframe 1 turning, for instance to the left (FIG. 27), case 3 is turned clockwise by means of locking hydraulic cylinders 17 (FIG. 27).

After trench digging has been completed, operating element 5 is withdrawn from the ground, lifted above ground level, and slide block 27 is locked by tie 56, by shifting it into the transportation position (I in FIG. 3) and fastening it to lugs 57 with index finger 59. Case 3 is secured against rotation on axes 12, 13 by hydraulic cylinders 17, extending their rods until they rest against end face of case 3, and by spacers 16, moving them into transportation position (I in FIG. 4) and fastening them on lifting frame 8 with index fingers 18. Hydraulic cylinders 22 are used to raise operating element 5 into extreme upper position and lifting hydraulic cylinders 15 are used to move working machinery 2 into transportation position (I in FIG. 1, 2).

In the transportation position working machinery 2 does not limit the maneuverability of base underframe 1 and practically does not affect the machine length which is determined by the length of base underframe.

For machine readjustment for uncovering a pipeline of, for instance, larger diameter, operating element 5 is moved into a position in which fasteners 91, 92 are located opposite each other, chain portions 19 are unlocked with respect to cross-piece 39, inner 74 and outer 75 elements of telescopic tie 70 are unlocked, power drive 90 mounted on fasteners 91, 92 is used to alternatively move apart chain portions 19 and appropriate distance sleeves 89 are mounted. Then chain portions 19 and elements 74, 75 of telescopic tie 70 are fixed; power drive 90 is removed and slide block 27 is replaced. A new setting of diameter D of pipeline and appropriate setting of depth $H_1$ are stored in the memory of computer 94 by means of keyboard 108 of input device 95.

Operation of a machine embodiment (FIG. 23, 24, 25) differs in that:

Working machinery 2 is moved from transportation position (FIG. 3) into working position (FIG. 1) by simultaneous forward motion of base underframe 1 and lowering of working machinery 2 by means of hydraulic cylinders 15. In this case arm 26 due to interaction with pipeline 7 or the ground, is turned into working position, until stops 130 rest against end face of bracket 129, whereafter bracket 129 and arm 26 are locked by index fingers 131. When working machinery is moved into transportation position, arm 26 in lifting of working machinery 2 by hydraulic cylinders 15, under its own weight and weight of slide block 27, turns until slide block 27 rests against case 3.

Figure 30:
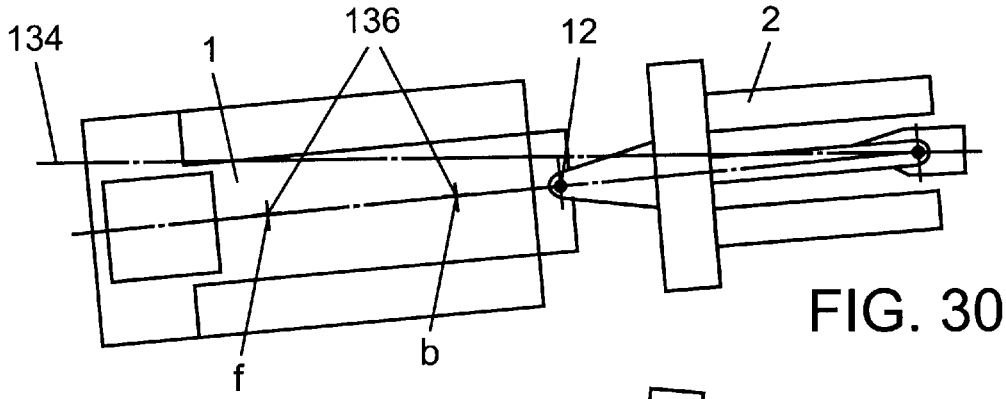
FIGS. 30 to 32 are the schematics of an embodiment of the claimed machine during maneuvering.
Figure 31:
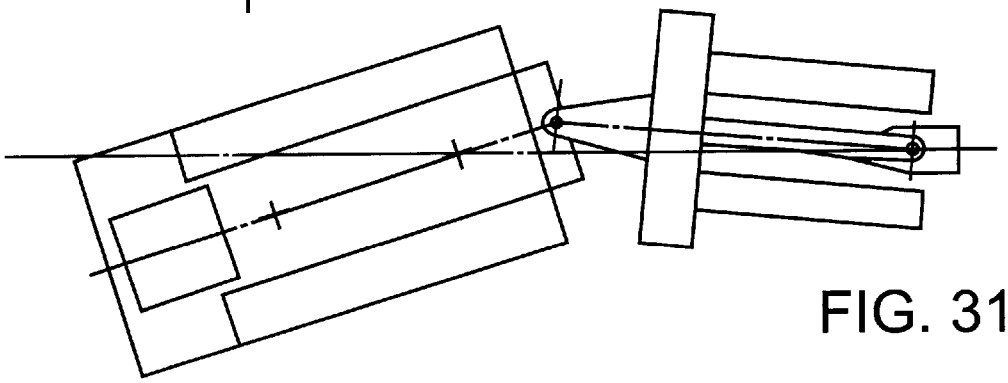
Figure 32:
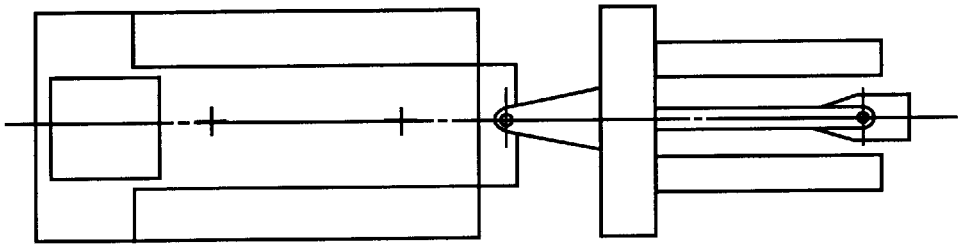

In maneuvering under critical conditions (FIG. 30 to 32) center of turn 136 of base underframe 1 is shifted forward and backward by changing force $Q_1$ of slide block 27 pressing to pipeline 7 by means of hydraulic cylinders 15. In this case rotation of base underframe 1 is performed in place by caterpillar reversal (FIG. 30 to 32) or reverse motion. In order to increase the angle of rotation of base underframe 1, at the moment of turning, operating element 5 can be withdrawn from the earth higher than pipeline 7.

During the machine maneuvering, by means of alternative turning of base underframe 1 with simultaneous shifting of the center of turn of the latter forward/backward by changing the force ($Q_1$ and $Q_2$) of pressing working machinery 2 (skids 60 or slide block 27) to the ground or the pipeline, base underframe 1 can move normal to the pipeline longitudinal axis. Consequently, the machine can move out of any critical situation and can uncover pipelines with curved sections of practically any, no matter how small, radius of curvature.

What is claimed is:

1. An apparatus for uncovering a buried pipeline, the apparatus comprising:

a base underframe; a rotary frame pivotally connected to the base underframe such that the rotary frame and the base underframe pivot about a first substantially vertical axis and a first substantially horizontal axis;

a first power drive connected to the rotary frame and the base underframe wherein the first power drive selectively applies a rotational force in a first and a second direction to the rotary frame whereby the first directional force raises the rotary frame and the second directional force lowers the rotary frame;

an operating element pivotally connected to the rotary frame such that the operating element pivots about a second substantially horizontal axis, the operating element having chain members rotatable around the operating element, wherein the rotating chain members remove soil from both sides of the buried pipeline;

a transfer device for transferring the soil removed by the operating element to a dump;

a second power drive connected to the operating element wherein the second power drive selectively applies a rotational force in a first and a second direction to the operating element whereby the first directional force raises the operating element and the second directional force lowers the operating element;

an arm pivotally connected to one of the rotary frame and the operating element wherein the arm pivots about a third substantially horizontal axis;

a following member pivotally connected to the arm wherein the following member pivots about a fourth substantially horizontal axis and a second substantially vertical axis, and the following member is adapted to rest on the buried pipeline such that a longitudinal axis of the following member is substantially parallel to a longitudinal axis of the buried pipeline;

a third power drive connected to the arm wherein the third power drive selectively applies a rotational force in a first and a second direction to the arm and following member whereby the first directional rotational force maintains the following member in contact with the buried pipeline and the second directional rotational force moves the following member away from the buried pipeline;

a plow connected to the following member wherein the plow removes a top layer of soil from a top edge of the buried pipeline and transfers the removed top layer of soil to the rotating chain members of the operating element;

a sensor for generating a signal indicative of an angle of the following member relative to the arm;

a controller for maintaining the operating element in a desired position relative to the buried pipeline in response to the signal; and means for preventing spontaneous rotation of the base underframe and rotary frame about the first substantially vertical axis.

2. The apparatus of claim 1, wherein the operating element has a pair of frames and a crosspiece mounted between the pair of frames of the operating element whereby the arm is rotatably connected to the crosspiece of the operating element.

3. The apparatus of claim 1, further comprising an indicator for providing a signal to the controller indicative of the angle of the arm in a vertical plane relative to the operating element.

4. The apparatus of claim 1, wherein the following member comprises:

a slide block with a contour matching a surface of the buried pipeline adapted to sliding over the buried pipeline;

an opening along the longitudinal axis of the following member; and spring-loaded grippers disposed opposite the opening.

5. The apparatus of claim 1, wherein the controller includes a computer responsive to at least one input indicative of a depth and a direction of the buried pipeline for automatically controlling the direction of the apparatus as soil is removed from around the buried pipeline.

6. The apparatus of claim 1, further comprising, an indicator for providing a signal to the controller indicative of an angle of the operating element in a vertical plane relative to the rotary frame.

7. The apparatus of claim 6, wherein the controller outputs at least one signal to the second power drive to automatically control rotation of the operating element relative to the rotary frame in response to the signal.

8. The apparatus of claim 1, further comprising, a link having first and second ends with a pivotal connector on each of the first and second ends of the link for connecting the base underframe to the pivotal connector on the first end of the link and connecting the rotary frame to the pivotal connector on the second end of the link whereby the base underframe pivots about a third substantially vertical axis disposed through the pivotal connector on the first end of the link and the rotary frame pivots about the first substantially vertical axis disposed through the pivotal connector on the second end of the link.

9. The apparatus of claim 1, further comprising, at least one support connected to the rotary frame and disposed between the base underframe and the operating element wherein the at least one support is adapted to provide a force between a surface of the soil and the rotary frame.

10. The apparatus of claim 9, further comprising, a third power drive proximate the support for providing the force between the surface of the soil and the rotary frame.

11. The apparatus of claim 1, wherein the arm is connected to the operating element.

12. The apparatus of claim 11, wherein the arm comprises first and second arm portions pivotally connected to pivot about a third substantially vertical axis whereby the following member is permitted to move laterally relative to a longitudinal axis of the first arm portion.

13. The apparatus of claim 12, further comprising, at least one support connected to the rotary frame and disposed between the base underframe and the operating element wherein the at least one support is adapted to provide a force between a surface of the soil and the rotary frame.

14. The apparatus of claim 13, further comprising, a fourth power drive proximate the support for providing the force between the surface of the soil and the rotary frame.

15. The apparatus of claim 12, further comprising, an indicator proximate the first and second arm portions for providing an indication of an angle between the first and second arm portions relative to the third substantially vertical axis to the controller.

16. The apparatus of claim 15, wherein the means for preventing spontaneous rotation of the base underframe and the rotary frame about the first substantially vertical axis comprises at least one locking power drive adapted to provide forced rotation of the base underframe and the rotary frame around the first substantially vertical axis.

17. The apparatus of claim 16, wherein the controller outputs at least one signal to the at least one locking power drive to automatically control the angle of the rotary frame and the base underframe relative to the first substantially vertical axis.

18. The apparatus of claim 16, further comprising, a link having first and second ends with a pivotal connector on each of the first and second ends of the link for connecting the base underframe to the pivotal connector on the first end of the link and connecting the rotary frame to the pivotal connector on the second end of the link whereby the base underframe pivots about a fourth substantially vertical axis disposed through the pivotal connector on the first end of the link and the rotary frame pivots about the first substantially vertical axis disposed through the pivotal connector on the second end of the link.

19. The apparatus of claim 1, wherein the arm is connected to the rotary frame.

20. The apparatus of claim 19, wherein the arm comprises first and second arm portions pivotally connected to pivot about a third substantially vertical axis whereby the following member is permitted to move laterally relative to a longitudinal axis of the first arm portion.

21. The apparatus of claim 20, further comprising, at least one support connected to the rotary frame and disposed between the base underframe and the operating element wherein the at least one support is adapted to provide force between a surface of the soil and the rotary frame.

22. The apparatus of claim 21, further comprising, a third power drive proximate the support for providing the force between the surface of the soil and the rotary frame.

23. The apparatus of claim 20, further comprising, an indicator proximate the first and second arm portions for providing an indication of an angle between the first and second arm portions relative to the third substantially vertical axis to the controller.

24. The apparatus of claim 23, wherein the means for preventing spontaneous rotation of the base underframe and the rotary frame about the first substantially vertical axis comprises at least one locking power drive adapted to provide forced rotation of the base underframe and the rotary frame around the first substantially vertical axis.

25. The apparatus of claim 24, wherein the controller outputs at least one signal to the at least one locking power drive to automatically control the angle of the rotary frame and the base underframe relative to the first substantially vertical axis.

26. The apparatus of claim 24, further comprising, a link having first and second ends with a pivotal connector on each of the first and second ends of the link for connecting the base underframe to the pivotal connector on the first end of the link and connecting the rotary frame to the pivotal connector on the second end of the link whereby the base underframe pivots about a fourth substantially vertical axis disposed through the pivotal connector on the first end of the link and the rotary frame pivots about the first substantially vertical axis disposed through the pivotal connector on the second end of the link.

27. An apparatus for uncovering a buried pipeline comprising:

a base underframe;

a rotary frame pivotally connected to the base underframe such that the rotary frame and the base underframe pivot about a first substantially vertical axis and a second substantially horizontal axis;

a first power drive connected to the rotary frame and the base underframe wherein the first power drive selectively applies a rotational force in a first and a second direction to the rotary frame whereby the first directional force raises the rotary frame and the second directional force lowers the rotary frame;

a second power drive disposed proximate the base underframe and the rotary frame wherein the second power drive causes the base underframe and rotary frame to pivot about the first substantially vertical axis;

an operating element pivotally connected to the rotary frame such that the operating element and the rotary frame pivot about a second substantially horizontal axis, the operating element having chain members rotatable around the operating element, wherein the rotating chain members remove soil from both sides of the buried pipeline;

a transfer device connected to the rotary frame for transferring the soil removed by the operating element to a dump;

a third power drive connected to the operating element wherein the third power drive selectively applies a rotational force in a first and a second direction to the operating element whereby the first directional rotational force raises the operating element and the second directional rotational force lowers the operating element;

an arm pivotally connected to one of the rotary frame and the operating element about a third substantially horizontal axis;

a following member pivotally connected to the arm wherein the following member pivots about a fourth substantially horizontal axis and a second substantially vertical axis, and the following member is adapted to rest on the buried pipeline such that a longitudinal axis of the following member is substantially parallel to a longitudinal axis of the buried pipeline;

the arm further comprises first and second arm portions pivotally connected to pivot about a third substantially vertical axis whereby the following member is permitted to move laterally relative to a longitudinal axis of the first arm portion;

a fourth power drive connected to the arm wherein the fourth power drive prevents spontaneous movement of the arm and secures the arm in a desired position relative to the rotary frame and operating element, and the fourth power drive selectively applies a rotational force in a first and a second direction to the arm and following member whereby the first directional rotational force maintains the following member in contact with the buried pipeline and the second directional rotational force moves the following member away from the buried pipeline;

a plow connected to the following member wherein the plow removes a top layer of soil from a top edge of the buried pipeline and transfers the removed top layer of soil to the rotating chain members of the operating element;

a sensor for generating a signal indicative of an angle of the following member relative to the arm; and a controller for maintaining the operating element in a desired position relative to the buried pipeline in response to the signal.

28. The apparatus of claim 27, further comprising, an indicator proximate the first and second arm portions for providing an indication of an angle between the first and second arm portions relative to the third substantially vertical axis to the controller.

29. The apparatus of claim 27, wherein the controller outputs at least one signal to the second power drive to automatically control the angle of the rotary frame and the base underframe relative to the first substantially vertical axis.

30. An operating element of an apparatus for uncovering a buried pipeline, the operating element comprising:

two frames each having first and second ends;

a drive shaft disposed at the first end of each of the frames;

a tension shaft disposed at the second end of each of the frames;

a chain wrapped around the each of the drive shafts, tension shafts, and the frames;

a machine transmission connected to the drive shaft for forced rotation of the chain around the outer shaft, frame, and tension shaft;

each of the drive shafts further includes:

an inner shaft rotatably connected to the machine transmission, and held by bearings in a rotary frame;

an outer shaft held by bearings in one of the frames, the outer shaft surrounding a portion of the inner shaft and rotationally connected to the inner shaft wherein the outer shaft is displaceable longitudinally along the inner shaft;

drive sprockets attached to the outer shaft for engaging the chain;

a first bearing support disposed on the rotary frame;

a second bearing support disposed on one of the frames;

at least one split distance sleeve surrounding the inner shaft and disposed between the first and second bearing supports for positioning the outer shaft in a predetermined longitudinal position from the first bearing support;

fasteners disposed on the first and second bearing supports adapted to hold a removable power drive;

a trench slope-forming mechanism comprising:

two L-shaped arms rotatably mounted on each of the frames between the chain, the L-shaped arms each having first and second ends;

a telescopic tie bar rotatably connect to each of the first ends of the L-shaped arms;

two back-slopers each having first and second ends, each of the first ends connected to one of the second ends of the L-shaped arms, and each of the seconds ends of the back-slopers connected to each of the tension shafts wherein each of the back-slopers is held in tension, and wherein the removable power drive displaces the outer shaft longitudinally along the inner shaft causing the telescopic tie bar to expand and contract in response to the longitudinal movement of the outer shaft; and a lock for locking the telescopic tie bar in a desired position.

* * * * *